US009441169B2

(12) United States Patent
Gargano et al.

(10) Patent No.: US 9,441,169 B2
(45) Date of Patent: Sep. 13, 2016

(54) PROCESS FOR REMOVING SULPHUR COMPOUNDS FROM HYDROCARBONS

(71) Applicant: Ultraclean Fuel Pty Ltd., Tuggerah New South Wales (AU)

(72) Inventors: Gordon John Gargano, Mardi (AU); Marc E. Halpern, Blackwood, NJ (US)

(73) Assignee: ULTRACLEAN FUEL PTY LTD, Tuggerah, New South Wales (AU)

( * ) Notice: Subject to any disclaimer, the term of this patent is extended or adjusted under 35 U.S.C. 154(b) by 154 days.

(21) Appl. No.: 14/216,602

(22) Filed: Mar. 17, 2014

(65) Prior Publication Data

US 2014/0299512 A1 Oct. 9, 2014

Related U.S. Application Data

(60) Provisional application No. 61/790,749, filed on Mar. 15, 2013.

(51) Int. Cl.

| | |
|---|---|
| ***C10G 27/00*** | (2006.01) |
| ***C10G 27/12*** | (2006.01) |
| ***C10G 27/04*** | (2006.01) |
| ***C10G 25/00*** | (2006.01) |
| ***C10G 25/12*** | (2006.01) |
| ***C10G 53/14*** | (2006.01) |
| ***C10G 21/06*** | (2006.01) |
| *C10G 27/02* | (2006.01) |

(52) U.S. Cl.

CPC ..... *C10G 27/04* (2013.01); *C10G 21/06* (2013.01); *C10G 25/003* (2013.01); *C10G 25/12* (2013.01); *C10G 27/12* (2013.01); *C10G 53/14* (2013.01); *C10G 2300/202* (2013.01)

(58) Field of Classification Search

CPC ..... C10G 27/00; C10G 27/02; C10G 27/12

See application file for complete search history.

(56) References Cited

U.S. PATENT DOCUMENTS

| | | | |
|---|---|---|---|
| 4,727,973 | A | 3/1988 | Estreicher et al. |
| 5,910,440 | A † | 6/1999 | Grossman |
| 6,160,193 | A | 12/2000 | Gore |
| 6,171,478 | B1 | 1/2001 | Cabrera et al. |
| 6,274,785 | B1 | 8/2001 | Gore |
| 6,277,271 | B1 | 8/2001 | Kocal |
| 6,402,939 | B1 | 6/2002 | Yen et al. |
| 6,406,616 | B1 | 6/2002 | Rappas et al. |

(Continued)

FOREIGN PATENT DOCUMENTS

| | | |
|---|---|---|
| AU | 200020723 | 9/2001 |
| CA | 1213918 | 11/1986 |

(Continued)

OTHER PUBLICATIONS

Arlt et al.; New classes of compounds for chemical engineering: ionic liquids and hyperbranched polymers; research paper; Upon knowledge and belief prior to Mar. 17, 2014; 13 pages; Technical University of Berlin, Institute fuer Verfahrenstechnik, Berlin, Germany.

(Continued)

*Primary Examiner* — Brian McCaig

(74) *Attorney, Agent, or Firm* — Thorpe North & Western LLP

(57) ABSTRACT

Processes are disclosed for reducing the sulphur content of a hydrocarbon material containing sulphur compounds.

60 Claims, 3 Drawing Sheets

(56) References Cited

U.S. PATENT DOCUMENTS

| | | | | |
|---|---|---|---|---|
| 6,596,914 | B2 † | 7/2003 | Gore | |
| 6,881,325 | B2 | 4/2005 | Morris et al. | |
| 7,001,504 | B2 | 2/2006 | Schoonover | |
| 7,175,755 | B2 | 2/2007 | De Souza | |
| 7,744,749 | B2 † | 6/2010 | Martinie | |
| 7,790,021 | B2 † | 9/2010 | Kocal | |
| 7,914,669 | B2 * | 3/2011 | Martinie | C10G 21/06 208/208 R |
| 2002/0029997 | A1 | 3/2002 | Rappas et al. | |
| 2002/0148756 | A1 | 10/2002 | Morris et al. | |
| 2003/0085156 | A1 | 5/2003 | Schoonover | |
| 2003/0149264 | A1 | 8/2003 | Boesmann | |
| 2004/0096932 | A1 | 5/2004 | Kragl et al. | |
| 2004/0118750 | A1 | 6/2004 | Gong et al. | |
| 2004/0262578 | A1 | 12/2004 | Boesmann | |
| 2005/0010076 | A1 | 1/2005 | Wasserscheid et al. | |
| 2005/0070717 | A1 | 3/2005 | Boesmann | |
| 2005/0085671 | A1 | 4/2005 | Bohnen et al. | |
| 2005/0090704 | A1 | 4/2005 | Roettger et al. | |
| 2005/0119516 | A1 | 6/2005 | Bolllman | |
| 2005/0287677 | A1 | 12/2005 | Boesmann | |
| 2006/0063945 | A1 | 3/2006 | Wasserscheid et al. | |
| 2007/0051667 | A1 | 3/2007 | Martinie et al. | |
| 2007/0227950 | A1 | 10/2007 | Martinie et al. | |
| 2009/0065399 | A1 | 3/2009 | Kocal et al. | |
| 2009/0242459 | A1 | 10/2009 | Soloveichik et al. | |
| 2011/0203972 | A1 | 8/2011 | Gargano et al. | |
| 2012/0018350 | A1 | 1/2012 | Lin et al. | |
| 2012/0091040 | A1 | 4/2012 | Sharma et al. | |
| 2012/0138449 | A1 † | 6/2012 | Basfar | |

FOREIGN PATENT DOCUMENTS

| | | | |
|---|---|---|---|
| CN | 1712497 | A | 12/2005 |
| CN | 101851529 | A | 1/2010 |
| DE | 4014176 | | 11/1991 |
| DE | 19901524 | | 7/2000 |
| DE | 19926924 | | 1/2001 |
| DE | 10132526 | | 1/2003 |
| DE | 102004027196 | | 12/2005 |
| DE | 102004033021 | | 2/2006 |
| DE | 102004024968 | | 3/2006 |
| DE | 102005008406 | | 4/2006 |
| EP | 0565324 | A1 | 10/1993 |
| EP | 1182196 | | 2/2002 |
| EP | 1182197 | | 2/2002 |
| EP | 1679307 | | 7/2006 |
| JP | 2001322953 | A | 11/2001 |
| WO | WO 98/47616 | | 10/1998 |
| WO | WO 00/16902 | | 3/2000 |
| WO | WO 00/20115 | | 4/2000 |
| WO | WO 00/34211 | | 6/2000 |
| WO | WO 00/41809 | | 7/2000 |
| WO | WO 01/48119 | | 7/2001 |
| WO | WO 02/18518 | | 3/2002 |
| WO | WO 02/49992 | | 6/2002 |
| WO | WO 02/092204 | | 11/2002 |
| WO | WO 03/039719 | | 5/2003 |
| WO | WO 03/106379 | | 12/2003 |
| WO | WO 2004/035542 | | 4/2004 |
| WO | WO 2004/067487 | | 8/2004 |
| WO | WO 2005/014547 | | 2/2005 |
| WO | WO 2005/023422 | | 3/2005 |
| WO | WO 2005/113702 | | 12/2005 |
| WO | WO 2005/113729 | | 12/2005 |
| WO | WO 2006/087333 | | 8/2006 |

OTHER PUBLICATIONS

Bossmann et al.; Deep desulfurization of diesel fuel by extraction with ionic liquids; Chemical Communications; 2001; pp. 2494-2495; The Royal Society of Chemistry.

Deshpande et al.; Ultrasound-Assisted, Base-Catalyzed Oxidation of 4,6-Dimethyldibenzothiophene in a Biphasic Diesel-Acetonitrile System; Energy & Fuels; 2005; pp. 28-34; vol. 19, No. 1; American Chemical Society.

Huang et al.; Desulfurization of Gasoline by Extraction with New Ionic Liquids; Energy & Fuels; 2004; pp. 1862-1864; vol. 18, No. 6; American Chemical Society.

Kanel; Overview: Industrial Application of Ionic Liquids for Liquid Extraction; Chemical Industry Vision 2020 Technology Partnership Workshop Sep. 11, 2003 Power Point presentation; May 19, 2004; 15 pages; J.S. Kanel & Associates, LLC.

Lo et al.; One-pot desulfurization of light oils by chemical oxidation and solvent extraction with room temperature ionic liquids; Green Chemistry; 20003; pp. 639-642; vol. 5; The Royal Society of Chemistry.

Minkel; Pinching Out Sulfur, Refining Ways to Turn Heavy Oil into Sweet Crude; Scientific American; Feb. 2006; pp. 25-27; Scientific American, Inc.

Zhang et al.; Extraction Desulfurization and Denitrogenation of Fuels Using Ionic Liquids; Industrial & Engineering Chemistry Research; 2004; pp. 614-622; vol. 43; American Chemical Society.

Jiang et al., Oxidative Desulfurization of Fuel Oils, pp. 707-715, 2011, Chinese Journal of Catalysis.†

Liu et al., Deep Desulfurization of Diesel Oil Oxidized by Fe (VI) Systems, pp. 422-428, 2008, Fuel.†

Fukuda et al., Imide-Catalyzed Oxidation System: Sulfides to Sulfoxides and Sulfones, pp. 4629-4631, 2010, J. Org. Chem.†

Ishihara et al., Oxidative Desulfurization and Denitrogenation of a Light Gas Oil Using an Oxidation/Adsorption Continuous Flow Process, pp. 279-287, 2004, Applied Catalysis a: General.†

Zhang et al., Research Advances in Oxidative Desulfurization Technologies for the Production of Low Sulfur Fuel Oils, pp. 196-207, 2009, Petroleum & Coal.†

* cited by examiner
† cited by third party

PROCESS FOR REMOVING SULPHUR COMPOUNDS FROM HYDROCARBONS

The present application claims the benefit of U.S. Provisional Patent Application No. 61/790,749 filed on Mar. 15, 2013, the entirety of which is incorporated herein by reference.

FIELD

The present invention relates to the removal of sulphur compounds from hydrocarbon streams.

BACKGROUND

The removal of sulphur compounds from fossil hydrocarbon (HC) streams, such as Natural Gas Condensate, Kerosene, Jet Fuel, Diesel and Fuel Oil, down to ultra low ppm levels is of major technical importance in industry and society due to the fact that sulphur containing compounds can have negative effects on technical operations and the environment. For instance, the presence of chemically-combined sulphur, such as organosulphur compounds, in hydrocarbon streams can cause corrosion of processing equipment and engine parts. Further, the emission of $SO_x$ and $NO_x$ (oxides of nitrogen and sulphur) from the combustion of fossil fuels containing sulphur and nitrogen, causes damage to the environment. Of particular concern is the presence of Poly Nuclear Aromatics (PAH) Sulphur, which when combusted, can produce toxic and probable carcinogenic compounds in the environment.

With increasing emphasis on eliminating or minimizing sulphur discharge to the atmosphere, attention has turned to the removal of sulphur and nitrogen compounds from hydrocarbon feedstocks before said hydrocarbons are combusted. Feedstock desulphurization is mandated in most countries of the world. Legislation in the United States currently limits the sulphur level in fuels such as gasoline and diesel hydrocarbon to 30 ppm and 15 ppm respectively. This limit of 15 ppm is more stringent in other parts of the world, such as the EU, where allowable sulphur levels are as low as ≤10 ppm. This is also the mandatory level adopted by other countries as well, such as Japan, Australia and New Zealand.

SUMMARY

The present disclosure generally relates to a process for reducing the sulphur content of hydrocarbon feedstocks such as Natural Gas Condensate, Kerosene, Jet Fuel, Diesel, Vacuum Gas Oil and Fuel Oil. In some embodiments, the disclosure relates to a process for removing a range of sulphur compounds from hydrocarbon material containing a range of sulphur compounds.

The process disclosed herein uses a tailored oxidation process comprising one or two oxidation steps to produce the corresponding oxidized sulphur compounds in the form of sulphoxides and/or sulphones. These sulphoxides and sulphones, whilst being still present in the liquid hydrocarbon streams, are subsequently extracted thereby producing a low sulphur hydrocarbon stream and following further treatment of the sulphoxides and/or sulphones, produce a low sulphur aromatic hydrocarbon stream and an aqueous stream of sodium sulphite or sulphuric acid. The low sulphur hydrocarbon stream and low sulphur aromatic hydrocarbon stream may be individually recycled or combined for recycling. In some embodiments, ultra low sulphur hydrocarbon and ultra low sulphur aromatic hydrocarbon streams are produced.

Accordingly, in at least a preferred embodiment, the process of the present invention advantageously provides an economically viable way of reducing sulphur levels in liquid hydrocarbons containing a variety of sulphur species to produce recyclable hydrocarbon streams, very low waste streams and minimal loss of hydrocarbon components.

In a first aspect there is provided a process for reducing the sulphur content of a hydrocarbon material containing sulphur compounds, the process comprising:

a) contacting the hydrocarbon material with one or more primary oxidants to oxidize the sulphur compounds to sulphoxide and/or sulphone compounds to provide a primary oxidised hydrocarbon material, wherein the primary oxidants have an ORP of up to about 1550 mV;

b) contacting the primary oxidised hydrocarbon material with a secondary oxidant to oxidize sulphur compounds not oxidised by the primary oxidant to sulphoxide and/or sulphone compounds to provide a secondary oxidised hydrocarbon material, wherein the secondary oxidant has an ORP of greater than about 1550 mV;

c) contacting the primary and/or secondary oxidised hydrocarbon material with an aqueous extractant to allow at least a portion of the sulphoxide and/or sulphone compounds to be extracted into the aqueous extractant to give a sulphoxide and/or sulphone stream and a low sulphur hydrocarbon stream; and d) contacting the sulphoxide and/or sulphone stream with a tertiary oxidant to give an aqueous sulphite stream and a low sulphur aromatic hydrocarbon stream, wherein the tertiary oxidant oxidises sulphone and/or sulphoxide compounds to sulphite compounds.

In one preferred embodiment, the primary oxidant is selected from one or more of the group consisting of:

a) N-chloroimide,
b) hypobromous acid
c) hypochlorous acid
d) electrolyzed oxidizing water and
e) catalysed and co-catalysed hydrogen peroxide.

The catalysed and co-catalysed hydrogen peroxide can be hydrogen peroxide catalysed by catalysts selected from the group including but not limited to transition metals, noble metals and breakdown rate control catalysts; and co-catalysed by a Phase Transfer Catalyst (PTC).

The breakdown rate control catalysts include but are not limited to phosphotungstic acid. The phosphotungstic acid can be formed from sodium tungstate dihydrate ($Na_2WO_4.2H_2O$) and phosphoric acid.

The PTC may be selected from the group including but not limited to: quaternary ammonium salts including but not limited to: quaternary ammonium hydrogen sulphates, such as tri-C8-10-alkylmethyl, hydrogen sulfates (e.g. Ultra C, being a proprietary PTC available from and developed by Ultraclean Fuel and PTC Organics); methyltrialkyl($C_8$-$C_{10}$) ammonium chloride (e.g. Adogen® 464 available from Evonik Industries); and N-Methyl-N,N-dioctyloctane-1-ammonium salts such as the chloride (e.g. Aliquat® 336 available from BASF); or equivalent PTC's known to those skilled in the art.

In one embodiment, the primary oxidant is catalysed and co-catalysed hydrogen peroxide wherein the catalysed and co-catalysed hydrogen peroxide is hydrogen peroxide catalysed by phosphotungstic acid comprising sodium tungstate dihydrate and phosphoric acid and co-catalysed with a phase transfer catalyst (PTC) comprising a quartenary ammonium hydrogen sulphate.

In another embodiment the secondary oxidant is selected from one or more of the group consisting of:

d) hydroxyl radicals, e) liquid ferrate (iron VI), f) chlorine dioxide and g) hyperfluorous acid/polar solvent.

In yet another embodiment, the hydrocarbon material containing sulphur compounds has a sulphur mass of >1000 ppm.

According to a second aspect, there is provided a process for reducing the sulphur content of a hydrocarbon material containing sulphur compounds, the process comprising:

a) contacting the hydrocarbon material with one or more primary oxidants to give a primary oxidised hydrocarbon material wherein the primary oxidant is selected from one or more of the group consisting of N-chloroimide, hypobromous acid, hypochlorous acid, electrolyzed oxidizing water and catalysed and co-catalysed hydrogen peroxide, such that the primary oxidant oxidizes sulphur compounds to sulphoxide and/or sulphone compounds;

and/or b) contacting the hydrocarbon material or primary oxidised hydrocarbon material with a secondary oxidant to give a secondary oxidised hydrocarbon material wherein the secondary oxidant is selected from one or more of the group consisting of hydroxyl radicals, liquid ferrate (iron VI), chlorine dioxide and hyperfluorous acid/polar solvent, such that the secondary oxidant oxidizes sulphur compounds to sulphoxide and/or sulphone compounds;

and c) contacting the primary and/or secondary oxidised hydrocarbon material with an aqueous extractant to allow at least a portion of the sulphoxide and/or sulphone compounds to be extracted into the aqueous extractant to give a sulphoxide and/or sulphone stream and a low sulphur hydrocarbon stream;

and d) contacting the sulphoxide and/or sulphone stream with a tertiary oxidant to give an aqueous sulphite stream and a low sulphur aromatic hydrocarbon stream, wherein the tertiary oxidant oxidises sulphone and/or sulphoxide compounds to sulphite compounds.

In one embodiment according to the second aspect, the catalysed and co-catalysed hydrogen peroxide can be hydrogen peroxide catalysed by catalysts selected from the group including but not limited to transition metals, noble metals and breakdown rate control catalysts; and co-catalysed by a phase transfer catalyst (PTC) as defined above.

In a preferred embodiment according to the second aspect, the catalysed and co-catalysed hydrogen peroxide is hydrogen peroxide catalysed by phosphotungstic acid comprising sodium tungstate dihydrate and phosphoric acid and co-catalysed by a phase transfer catalyst (PTC) comprising a quaternary ammonium salt, preferably a quartenary ammonium hydrogen sulphate.

In another embodiment of the second aspect, when the primary oxidant is catalysed and co-catalysed hydrogen peroxide as described above, the process includes steps a) and b).

In yet another embodiment of the second aspect, when the primary oxidant is catalysed and co-catalysed hydrogen peroxide as described above, the process includes only step a).

One advantage of an embodiment of the process disclosed herein is its ability to reduce the sulphur content of a range of hydrocarbons which contain a variety of sulphur compounds of varying complexity and resistance to oxidation. An advantage of another embodiment of the process disclosed herein, is the ability to perform a two step oxidation process to oxidise a range of sulphur containing hydrocarbon compounds with varying resistance to oxidation. An advantage of yet another embodiment of the process disclosed herein, is the ability to produce a low sulphur hydrocarbon stream and a low sulphur aromatic stream.

Accordingly, one embodiment of the first and second aspects provides a process for reducing the sulphur content of a hydrocarbon material containing sulphur compounds, the process comprising:

a) contacting the hydrocarbon material with one or more primary oxidants to provide a primary oxidised hydrocarbon material such that the primary oxidant oxidizes the sulphur compounds to sulphoxide and/or sulphone compounds, wherein the primary oxidant is selected from one or more of the group consisting of N-chloroimide, hypobromous acid, hypochlorous acid, electrolyzed oxidizing water and catalysed and co-catalysed hydrogen peroxide, and wherein the catalysed and co-catalysed hydrogen peroxide is hydrogen peroxide catalysed by phosphotungstic acid and co-catalysed by a phase transfer catalyst (PTC), preferably a quaternary ammonium salt, more preferably a quaternary ammonium hydrogen sulphate;

and b) contacting the primary oxidised hydrocarbon material with a secondary oxidant to provide a secondary oxidised hydrocarbon material wherein the secondary oxidant is selected from one or more of the group consisting of hydroxyl radicals, liquid ferrate (iron VI), chlorine dioxide and hyperfluorous acid/polar liquid solvent, such that the secondary oxidant oxidizes sulphur compounds to sulphoxide and/or sulphone compounds;

and c) contacting the primary and/or secondary oxidised hydrocarbon material with an aqueous extractant to allow at least a portion of the sulphoxide and/or sulphone compounds to be extracted into the aqueous extractant to give a sulphoxide and/or sulphone stream and a low sulphur hydrocarbon stream;

and d) contacting the sulphoxide and/or sulphone stream with a tertiary oxidant to give an aqueous sulphite stream and a low sulphur aromatic hydrocarbon stream, wherein the tertiary oxidant oxidises sulphone and/or sulphoxide compounds to sulphite compounds.

Another embodiment of the first and second aspects provides a process for reducing the sulphur content of a hydrocarbon material containing sulphur compounds, the process comprising:

a) contacting the hydrocarbon material with one or more primary oxidants to provide a primary oxidised hydrocarbon material such that the primary oxidant oxidizes the sulphur compounds to sulphoxide and/or sulphone compounds, wherein the primary oxidant is catalysed and co-catalysed hydrogen peroxide and wherein the catalysed and co-catalysed hydrogen peroxide is hydrogen peroxide catalysed by phosphotungstic acid and co-catalysed with a phase transfer catalyst (PTC) comprising a quaternary ammonium salt, preferably a quarternary ammonium hydrogen sulphate;

and b) contacting the primary oxidised hydrocarbon material with a secondary oxidant to provide a secondary oxidised hydrocarbon material wherein the secondary oxidant is selected from one or more of the group consisting of hydroxyl radicals, liquid ferrate (iron VI), chlorine dioxide and hyperfluorous acid/polar liquid solvent, such that the secondary oxidant oxidizes sulphur compounds to sulphoxide and/or sulphone compounds;

and c) contacting the primary and/or secondary oxidised hydrocarbon material with an aqueous extractant to allow at least a portion of the sulphoxide and/or sulphone compounds to be extracted into the aqueous extractant to give a sulphoxide and/or sulphone stream and a low sulphur hydrocarbon stream;

and d) contacting the sulphoxide and/or sulphone stream with a tertiary oxidant to give an aqueous sulphite stream and a low sulphur aromatic hydrocarbon stream, wherein the tertiary oxidant oxidises sulphone and/or sulphoxide compounds to sulphite compounds.

In yet another embodiment of the second aspect, there is provided a process for reducing the sulphur content of a hydrocarbon material containing sulphur compounds, the process comprising the steps of:

a) contacting the hydrocarbon material with one or more primary oxidants to provide a primary oxidised hydrocarbon material such that the primary oxidant oxidizes the sulphur compounds to sulphoxide and/or sulphone compounds, wherein the primary oxidant is catalysed and co-catalysed hydrogen peroxide and wherein the catalysed and co-catalysed hydrogen peroxide is hydrogen peroxide catalysed by phosphotungstic acid and co-catalysed with a phase transfer catalyst (PTC) comprising a quaternary ammonium salt, for example, a quarternary ammonium hydrogen sulphate;

c) contacting the primary oxidised hydrocarbon material with an aqueous extractant to allow at least a portion of the sulphoxide and/or sulphone compounds to be extracted into the aqueous extractant to give a sulphoxide and/or sulphone stream and a low sulphur hydrocarbon stream;

and d) contacting the sulphoxide and/or sulphone stream with a tertiary oxidant to give an aqueous sulphite stream and a low sulphur aromatic hydrocarbon stream, wherein the tertiary oxidant oxidises sulphone and/or sulphoxide compounds to sulphite compounds.

In the above embodiment, a secondary oxidant, as hereinbefore described in step b), is not used in the process. Only the primary and tertiary oxidant, as hereinbefore described, are used in the process according to this embodiment.

The primary oxidant oxidises sulphur compounds in the hydrocarbon material to sulphoxides and/or sulphones to give a primary oxidised hydrocarbon material. According to the second aspect and a preferred embodiment of the first aspect, the primary oxidant is selected from one or more of the group consisting of N-chloroimide, hypobromous acid, hypochlorous acid, electrolyzed oxidizing water and catalysed/co-catalysed hydrogen peroxide as herein before defined. Generally, the primary oxidant is employed to oxidise the electron rich sulphur compounds as well as sulfides, disulfides and mercaptans. Preferably, the primary oxidant oxidises sulphur compounds with an electron density on the sulphur atom higher than about 5.739.

In one embodiment of the second aspect, the primary oxidant has an oxidation reduction potential (ORP) of up to about 1.55 (1.550 mV).

In one embodiment of the first and second aspect, the primary oxidant is N-chloroimide. N-chloroimide can be prepared by reaction of sodium hypochlorite, water and an imide, preferably cyanuric acid. More preferably the N-chloroimide is prepared in situ, and is prepared as required during the course of the inventive process.

In another embodiment, the primary oxidant is hypobromous acid. Hypobromous acid can be prepared by electrolysis of hydrogen bromide in water, more preferably, it is prepared in situ by electrolysis of hydrogen bromide in water. In one preferred embodiment, regeneration of bromine via electrolysis allows for recycling of the primary oxidant.

In another embodiment, the primary oxidant is hypochlorous acid. Hypochlorous acid can be formed by reduction of sodium hypochlorite in water, preferably to provide a FAC (free available chlorine) content of between about 1000 ppm and 30000 ppm. Preferably, hypochlorous acid is formed in the presence of acids such as muriatic acid, mild sulfuric or citric acid to achieve a pH level of between about 4.5 and 6.5, this pH range being preferable for the maximum production of hypochlorous acid.

In another embodiment, the primary oxidant is catalysed and co-catalysed hydrogen peroxide. The catalysed and co-catalysed hydrogen peroxide are as defined above.

In one embodiment, the primary oxidant is electrolysed oxidising water. Electrolysed oxidising water can be prepared according to known methods.

The hydrocarbon material containing sulphur compounds is preferably a liquid hydrocarbon material containing sulphur compounds. Examples of preferred liquid hydrocarbon materials containing sulphur compounds include but are not limited to diesel fuels, jet fuel feedstock, natural gas condensate (NGC).

In one embodiment, the hydrocarbon material is contacted with the primary oxidant in at least a stoichiometric amount for the conversion of sulphur compounds to sulphoxide and/or sulphone compounds and thereby provide the primary oxidised hydrocarbon. In another embodiment the amount of primary oxidant is proportionally metered in at a rate equivalent to between 2 moles and 4 moles of oxidant to 1 mol of sulphur, for example, as detected by an on-line Total Sulphur Analyzer.

In one embodiment, the hydrocarbon material is contacted with the primary oxidant at a temperature in the range of about: 20° C.-70° C., 50-70° C., 50-65° C., 55-65° C., 60-65° C., 30-65° C. or about 20-40° C. and a pressure in the range of about: 20 PSI (140 kPa)-100 PSI (700 kPa), about 20 PSI (140 kPa)-50 PSI (350 kPa), or about 30 PSI (210 kPa)-50 PSI (350 kPa).

In one embodiment, the hydrocarbon material is heated in the range of about 30-65° C. prior to step a). Preferably, it is introduced into the primary oxidation reactor at a pressure of in the range of about 140 kPa to 350 kPa.

The primary oxidant can be introduced to the primary oxidation reactor at the same time as the hydrocarbon material.

In some embodiments, the primary oxidant is used in the absence of catalysts (such as transition and/or noble metals) or co-catalyst (such as quaternary ammonium salts as Phase Transfer Catalyst (PTC)). In other embodiments, such as when hydrogen peroxide is the primary oxidant, catalysts and co-catalysts are present.

In the first aspect, the primary oxidised hydrocarbon material is further oxidised using the secondary oxidant to further oxidise any sulphur compounds not oxidised by the first oxidant.

The process according to the second aspect allows the hydrocarbon material to be oxidised by the primary oxidant, the secondary oxidant or both the primary and secondary oxidants depending on the sulphur species present in the hydrocarbon material. In one embodiment, the primary oxidised hydrocarbon material contains both sulphur containing compounds and sulphoxide and/or sulphone compounds. In this embodiment, it may be desirable to further contact the primary oxidised hydrocarbon with the secondary oxidant in order to oxidise the remaining sulphur compounds. This may be required if the hydrocarbon being processed contains more thiophenes and benzothiophenes as these species are resistant to oxidation. Without being bound by theory, this is considered in part to be due to their relatively low electron densities or electron poor or deprived. For instance thiophene in the form of trimethyl benzothiophene, has been found to be very resistant to oxidation.

The primary and secondary oxidants oxidise the sulphur compounds to sulphoxide and/or sulphone compounds to give an oxidised hydrocarbon material. According to the second aspect and a preferred embodiment of the first aspect, the secondary oxidant is selected from one or more of the group consisting of hydroxyl radicals, liquid ferrate (iron VI), chlorine dioxide or hyperfluorous acid/polar solvent.

According to the second aspect, the secondary oxidant may be used in addition to and after treatment with the primary oxidant or in place of the first oxidant. In one embodiment, the primary oxidised hydrocarbon material contains sulphoxide and/or sulphone compounds but no sulphur containing compounds. In this embodiment, no further oxidation steps to oxidise the sulphur compounds are required. In another embodiment, the secondary oxidant oxidises any sulphur compounds that have not been oxidised by the primary oxidant to sulphoxide and/or sulphone compounds. Generally, a secondary oxidant will be required if the primary oxidant does not quantifiably oxidize the sulphur compounds in the hydrocarbon material.

The secondary oxidant is primarily employed to oxidise sulphur compounds that are relatively electron depleted (i.e. have a low electron density on the sulphur atom). Preferably, the secondary oxidant oxidises sulphur compounds with an electron density on the sulphur atom is ≤5.73.

According to the first aspect and a preferred embodiment of the second aspect, the secondary oxidant has an oxidation reduction potential (ORP) of ≥1550 mV. In one embodiment, the secondary oxidant has an oxidation reduction potential (ORP) ≥1700 mV. In another embodiment the ORP of the secondary oxidant is ≥1900 mV. In another embodiment, the ORP is in the range of about 1550-2200 mV. The secondary oxidant has a higher ORP than the primary oxidant.

In one embodiment, the secondary oxidant is contacted with the primary oxidised hydrocarbon material or the hydrocarbon material in at least a stochiometric amount for the conversion of sulphur compounds to sulphoxide and/or sulphone compounds and thereby provide the secondary oxidised hydrocarbon material. In another embodiment, the secondary oxidant is contacted with the primary oxidised hydrocarbon material or hydrocarbon material in a stoichiometric excess of >1 mol oxidant to about 1 mol of sulphur, or about 1-3 moles of oxidant to about 1 mol of sulphur, or about 2-3 moles of oxidant to about 1 mol of sulphur. The secondary oxidant can be contacted with the primary oxidised hydrocarbon material or the hydrocarbon material at a temperature of less than about 35° C., or in the range of about 15-35° C. and at a pressure of less than about 700 kPa, or in the range of about 100-700 kPa; or about 125-350 kPa. In one embodiment contact occurs for a period of time in the range of about 30 seconds to 10 minutes, or about 40 seconds to 5 minutes, or about 1-4 minutes.

In one specific embodiment of the first and second aspect, the secondary oxidant is chlorine dioxide which can be in the form of a stabilised water solution having a chlorine dioxide content in the range of about 3000 ppm (0.3%) to 8000 ppm (0.8%). The chlorine dioxide can be supplied to the reaction at a temperature in the range of about 15-35° C., or about 18-25° C. and at a pressure of about 140 kPa to 700 kPa.

In another specific embodiment of the first and second aspect, the secondary oxidant is hypofluorous acid in a polar solvent including but not limited to acetonitrile. In this embodiment, hypofluorous acid in acetonitrile can be prepared by bubbling a gaseous mixture comprising fluorine and nitrogen into liquid acetonitrile to form the oxidant in the form of an $HOF.CH_3CN$ electrophilic oxidant, wherein the concentration of fluorine mixed with nitrogen does not exceed about 20% by weight, or is in the range of about 15% to 20%, or in the range of about 10% to 15% by weight fluorine blended with the nitrogen. In one embodiment, the secondary oxidant is supplied to a secondary oxidizing reactor at room temperature, or less than about 25° C. (77° F.), or at about 20° C. (68° F.), or at about 15° C. (59° F.) and at a pressure in the range of about 30 PSI (140 kPa) to 100 PSI (700 kPa).

In another embodiment of the first and second aspect, the secondary oxidant is hydroxyl radicals. In this embodiment, a stoicheometric amount of the secondary oxidant can be added to secondary oxidation reactor in the range of about 1 minute to 5 minutes, or about 2 minutes to 4 minutes, or about 3 to 3.5 minutes, at a temperature of less than about 25° C. (77° F.), or at about 25-15° C., or at about 20° C. (68° F.), or at about 15° C. (59° F.) and at pressure in the range of about 30 PSI (140 kPa) to 100 PSI (700 kPa).

In yet another specific embodiment of the first and second aspect, the secondary oxidant is Liquid Ferrate VI. In this embodiment, a stoichiometric amount of the secondary oxidant can be added to secondary oxidation reactor and the Liquid Ferrate is produced on site by reaction involving caustic, bleach and ferric chloride. The Liquid ferrate VI can be mixed vigorously with the hydrocarbon material or first oxidised hydrocarbon for a time in the range of about 1-5 minutes, or about 2 minutes to 4 minutes, or about 3 to 3.5 minutes at a temperature less than about 25° C. (77° F.), or in the range of about 25-15° C., or at about 20° C. (68° F.), or at about 15° C. (59° F.) and at pressure in the range of about 30 PSI (140 kPa) to 100 PSI (700 kPa).

Empirical testing has confirmed that the oxidation of sulphur compounds is not appreciably more complete after two oxidation cycles are effected. Accordingly, in a preferred embodiment of the process disclosed herein, it will be most efficient if no more than two oxidation cycles are required as the effective oxidation rate decreases very markedly after two oxidation reactions.

According to step c) of the first and second aspects disclosed herein, at least a portion of the sulphoxide and/or sulphone compounds are extracted into an aqueous extractant to give a sulphone/sulphoxide stream and a separate low sulphur hydrocarbon stream. In one embodiment, most or all of the sulphoxide and/or sulphone compounds are extracted into the aqueous extractant. The aqueous extractant can be in the form of an ionic liquid (IL) or an alternate polar extraction solvent. In one embodiment, the primary and/or secondary oxidised hydrocarbon material is contacted with an ionic liquid (IL) or a polar extraction solvent for a time and under conditions to allow at least a portion of the sulphoxide and/or sulphone compounds to be extracted or absorbed into the extraction solvent or liquid. In one embodiment, the aqueous extractant is a polar extraction solvent selected from the group consisting of DMF, DMSO, methanol, water, brine, furfural, acetonitrile. For instance, a liquid/liquid extraction or ion exchange adsorption process can be used to extract the sulphone/sulphoxide compounds.

The extraction solvent can be an IL of the general composition $Q^+A^-$, where $Q^+$ is a quaternary ammonium or phosphonium cation and $A^-$ is an inorganic or organic anion, selected such that the IL is in a liquid state at the operating temperature and pressure of the process.

Multiple aqueous extractions and water washes can be carried out in the process of the first and second aspects disclosed herein. In one embodiment, most or all of the sulphoxide and/or sulphone compounds are extracted into an aqueous extractant to give a low sulphur hydrocarbon stream following contact with one aqueous extractant. In another embodiment, most or all of the sulphoxide and/or sulphone compounds are extracted into an aqueous extractant to give a low sulphur hydrocarbon stream following multiple aqueous extractions, i.e following contact with more than one aqueous extractants.

The primary or secondary oxidised hydrocarbon material can be contacted with the aqueous extractant either directly after oxidation or optionally after a water washing extraction step.

The step of contacting the hydrocarbon material with the oxidant can be conducted with the extractant, concurrently with or after contacting with the extractant.

In one embodiment, a portion of the sulphoxide and/or sulphone compounds can be extracted from the primary oxidised hydrocarbon material after steps a) and from the secondary oxidised hydrocarbon material after step c), to give a sulphone/sulphoxide stream and a low sulphur hydrocarbon stream.

According to one embodiment of the first and second aspect, the first and/or second oxidised hydrocarbon material obtained from step a) and/or step c) are washed with water.

According to another embodiment of the first and second aspect, step c) further includes a water washing step before the sulphoxide and/or sulphone stream and the low sulphur hydrocarbon stream are separated.

The tertiary oxidant oxidises the sulphoxide and/or sulphone compounds to sulphite compounds in step d) of the first and second aspects of the process disclosed herein. It will be understood that the tertiary oxidant will be of a strength that is able to oxidise the sulphoxide and/or sulphone group of a compound to a sulphite group. In one embodiment, the tertiary oxidant is a caustic solution. The tertiary oxidant can be selected from the group consisting of:

i) sodium hydroxide, ii) potassium hydroxide; and iii) hydroxyl radicals.

In other embodiments, oxidation with the tertiary oxidant is carried out in a range of about 40-95° C.

In one embodiment, sodium hydroxide is the tertiary oxidant. Oxidation of the sulphone and/or sulphoxide compounds with sodium hydroxide solution forms aqueous sodium sulphite. The sodium hydroxide solution can be in a concentration of about 30-60%, or about 50%. Preferably, the stoichiometric ratio of sulphone and/or sulphoxide to sodium hydroxide is about 1:1. The oxidation can be carried out at a temperature in the range of about 40-95° C., or about 50-85° C. In one embodiment, the tertiary oxidant and the sulphoxide and/or sulphone stream are agitated for a period of up to about 12 minutes, or up to about 10 minutes or up to about 8 minutes.

In another embodiment, the tertiary oxidant is hydroxyl radicals. Oxidation of the sulphone and/or sulphoxide compounds with hydroxyl radicals forms a sulphite and following addition of water forms sulphuric acid. Preferably, the stoichiometric ratio of hydroxyl radicals to sulphone/sulphoxide is in the range of about 1:1 to 4:1, in one embodiment the stoichiometric ratio is about 2:1, in another it is about 1:1. The oxidation can be carried out at a temperature up to about 75° C., or up to about 70° C., or up to about 65° C., or in the range of about 20° C. (68° F.) to 50° C. (122° F.) for a period sufficient to oxidize the sulphoxide/sulphones ($SO/SO_2$) compounds to sulphite compounds ($SO_3$). In one embodiment, hydroxyl radicals can be present as components of UV catalysed humid air or catalysed $H_2O_2$. The tertiary oxidant and the sulphoxide/sulphone rich stream can be agitated for a period in the range of about 10-20 minutes.

In another embodiment, the low sulphur hydrocarbon stream and the low sulphur aromatic compound are combined and recycled as low sulphur hydrocarbon fuel.

In one embodiment according to all the aspects, the sulphur content of the hydrocarbon material is analysed before contact with the first and/or second oxidant using known detectors such as a S-sensitive X-ray Fluorescence detector. In another embodiment, the mass of sulphur is determined. In yet another embodiment, the mass and content of sulphur compounds is determined.

In another embodiment, the sulphite compounds produced by oxidation with the tertiary oxidant are used for further processing.

The process according to the first and second aspect may further comprise: e) contacting the low sulphur hydrocarbon stream obtained in step c) with an adsorbent to remove residual sulphur compounds from the low sulphur hydrocarbon stream to provide an ultra low sulphur hydrocarbon stream (or ULSD). In one embodiment the adsorbent is selected from physical or physiochemical adsorbents, preferably Y-zeolite, activated carbon, Cu Impregnated Chabazite, Fuller's Earth and Metal Oxide Framework (MOF).

In another embodiment, following step e) the loaded absorbent is regenerated/purged using heater $N_2$, stripping to desorb sulphur compounds from the adsorbent.

The process according to the first and second aspect may further include the step of separating the sulphone/sulphoxide stream and the low sulphur hydrocarbon stream produced in step c).

In a preferred embodiment of the first and second aspect, the low sulphur hydrocarbon stream is polished to remove any residual sulphur compounds using adsorbents including MOF (Metal Organic Framework) groups including but not limited to Basolite ($C_{18}H_6Cu_3O_{12}$)—Copper Benzene-1,3,5-Tricarboxylate), Selexsorb Metal Oxide Purification Adsorbent group of adsorbents, $CuCl_2$MIL-47 MOF, Y-Zeolite, Molecular Imprinted Chitosan, Cu Impregnated Chabazite, Fuller's Earth or Activated Carbon.

In another embodiment of the process of the first and second aspects, following step d), the aromatic compound stream is blended with the low sulphur hydrocarbon stream.

The process according to the first or second aspect may further include a pre-mixing step before step a).

In a third aspect, there is provided a method for regenerating an aromatic and/or aliphatic sulphone and/or sulphoxide compound to a sulphone and/or sulphoxide free aromatic and/or aliphatic compound comprising contacting the aromatic and/or aliphatic sulphone and/or sulphoxide compound with hydroxyl radicals to form the sulphone and/or sulphoxide free aromatic or aliphatic compound and a sulphite.

In one embodiment, the sulphite is hydrated to sulphuric acid.

In another embodiment the aromatic and/or aliphatic sulphone and/or sulphoxide compound is the sulphoxide/sulphone compound formed in the process according to the first or second aspect disclosed herein.

In a fourth aspect, there is provided a method of oxidising a sulphur containing hydrocarbon material to a sulphoxide and/or sulphone containing hydrocarbon material, comprising contacting the sulphur containing hydrocarbon material with a primary oxidant selected from the group consisting of N-chloroimide, hypobromous acid, catalysed and co-catalysed hydrogen peroxide and electrolyzed oxidizing water, wherein the hypobromous acid is prepared in situ by electrolysis of hydrogen bromide in water wherein the hypobromous acid is regenerated and recycled in the process following oxidation of the sulphur containing hydrocarbon material.

In one embodiment of the fourth aspect, the hydrogen peroxide is catalysed by catalysts selected from the group including but not limited to transition metals, noble metals and breakdown rate control catalysts; and co-catalysed by a Phase Transfer Catalyst (PTC) as disclosed herein according to the first aspect.

In a fifth aspect, there is provided a method of oxidising a sulphur containing hydrocarbon material to a sulphoxide and/or sulphone containing hydrocarbon material, comprising contacting the sulphur containing hydrocarbon material with a secondary oxidant selected from one or more of the group consisting of hydroxyl radicals, liquid ferrate (iron VI), chlorine dioxide and hyperfluorous acid/acetonitrile.

In one embodiment the hydroxy radicals are produced in situ by exposing humid air to $TiO_2$ catalysed by UV light energy.

In a sixth aspect, there is disclosed use of quaternary ammonium salts as a co-catalyst with catalysed hydrogen peroxide in the oxidation of sulphur compounds in a hydrocarbon material.

In one embodiment of the sixth aspect, the catalysed hydrogen peroxide is hydrogen peroxide catalysed by a catalyst selected from the group including but not limited to transition metals, noble metals and breakdown rate control catalysts.

The breakdown rate control catalysts include but are not limited to phosphotungstic acid. The phosphotungstic acid can be formed from sodium tungstate dihydrate ($Na_2WO_4.2H_2O$) and phosphoric acid.

In another embodiment of the sixth aspect, the quaternary ammonium salts are PTC selected from the group including but not limited to: tri-C8-10-alkylmethyl, hydrogen sulfates (e.g. Ultra C, being a proprietary PTC available from and developed by Ultraclean Fuel and PTC Organics); methyltrialkyl($C_8$-$C_{10}$)ammonium chloride (e.g. Adogen 464 available from Evonik Industries); and N-Methyl-N,N-dioctyloctane-1-ammonium salts such as the chloride (e.g. Aliquat 336 available from BASF).

DEFINITIONS

By sulphur compound, it will be understood that the compound contains a —S—, —S—S—, Metal=S, C=S or —SH group.

By sulphoxide compound, it will be understood that the compound contains a —S(=O)— group.

By sulphone compound, it will be understood that the compound contains a —$S(=O)_2$.

By "hydrocarbon material containing sulphur compounds" it will be understood to mean material made up of aliphatic and/or aromatic hydrocarbons that contain sulphur compounds that is to be subject to the process disclosed herein to reduce the sulphur content. It may, hereinafter also be referred to as the "hydrocarbon feedstock", "feedstock" or "feed stream" etc.

By "low sulphur hydrocarbon", as referred to in step c) in the first and second aspects described herein, it will be understood to mean that the proportion of sulphur compounds in the hydrocarbon material is lower than the proportion of sulphur compounds in the "hydrocarbon material containing sulphur compounds" as it existed before step a), being before contact with the primary and/or secondary oxidants. In a preferred embodiment an "ultra low sulphur hydrocarbon" or "ULSD" stream is produced from the low sulphur hydrocarbon stream. It will be understood that the ULSD has a lower sulphur content than the "low sulphur hydrocarbon".

The "low sulphur hydrocarbon stream" may contain sulphoxide and/or sulphone compounds in varying amounts depending on the degree of their removal following aqueous extraction.

The phrase "sulphoxide and/or sulphone stream" as referred to in step c) in the first and second aspects described herein, will be understood to mean any amount of sulphoxide and/or sulphone obtained following aqueous extraction of the oxidised hydrocarbon material. It will be appreciated that the "stream" obtained from a first extraction of an oxidised hydrocarbon material may contain more sulphoxide and/or sulphone than subsequent steams obtained following multiple extractions of the same oxidised hydrocarbon material.

By "low sulphur aromatic hydrocarbon", as referred to in step d) in the first and second aspects of the invention, it will be understood to mean that the proportion of sulphur compounds in the aromatic hydrocarbon material is lower than the proportion of sulphur compounds in the "hydrocarbon material containing sulphur compounds" as it existed before step a), being before contact with the primary and/or secondary oxidants. It may, hereinafter, also be referred to as the "low sulphur aromatic" or in a preferred embodiment, "ultra low sulphur aromatic hydrocarbon" or "ULS Aromatics" wherein the level of sulphur is lower than that in the "low sulphur aromatic".

ULS Aromatics typically refers to a level of PAH (poly nuclear aromatics) of <5% by volume in Japan, Australia and most of Europe with the exception of Sweden which has a maximum limit of <3%. In the USA particularly California the total aromatic concentration is 10% by volume whilst in most US states the limit is substantially higher.

DETAILED DESCRIPTION OF EMBODIMENTS

Figure 1:
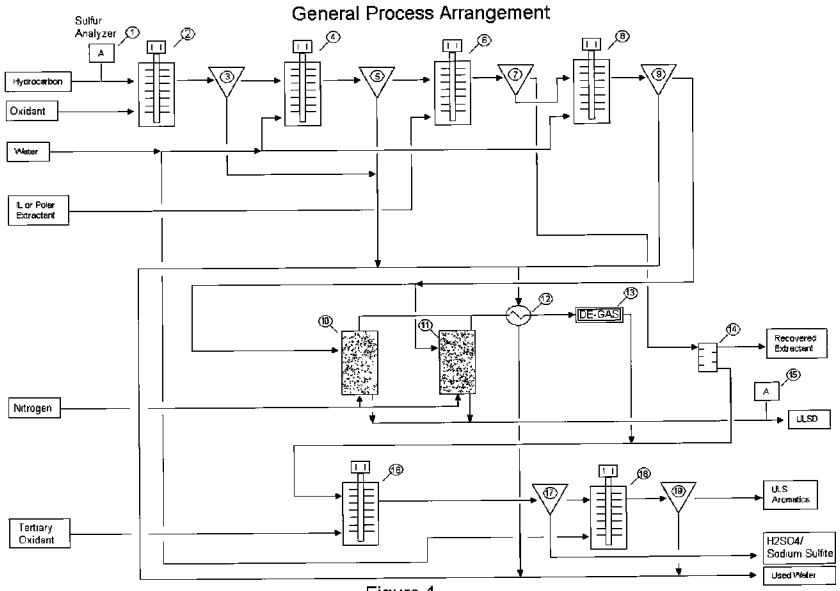
FIG. 1 shows a general scheme for the process disclosed herein according to a preferred embodiment of the second aspect using a primary oxidant.
Figure 1A:
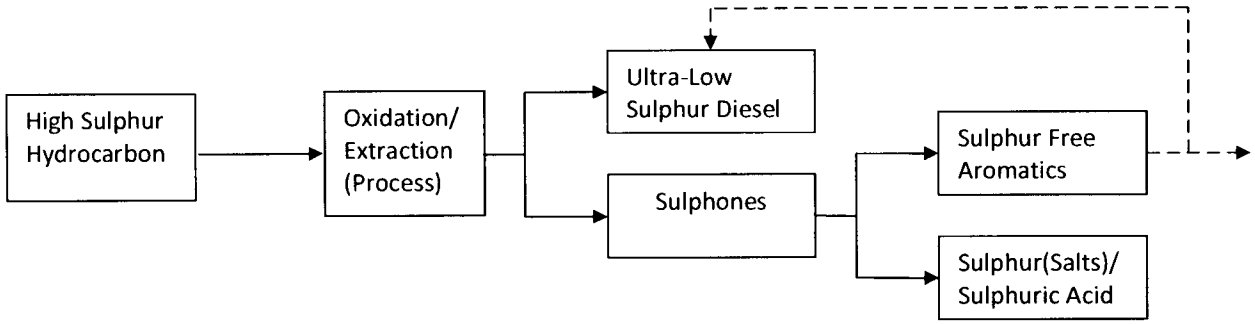
FIG. 1A shows an elementary flow diagram of a preferred embodiment of the process disclosed herein.

In one embodiment, the process disclosed herein uses an oxidation philosophy combined with a further process which transforms the sulphoxides and/or sulphones to sulphur-free aromatic hydrocarbons which can remain in the ultra low sulphur hydrocarbon stream if sulphur free aromatics are able to be blended into the ultra low sulphur hydrocarbon stream and do not breach maximum aromatics specifications thus enabling the aromatic hydrocarbon to be blended with the ultra low sulphur hydrocarbon stream. However if aromatic limits are reached, the separated ultra low sulphur aromatics can be sold as a valuable low sulphur aromatic hydrocarbon stream.

This renders possible, the production of ultra low sulphur hydrocarbon such as diesel (ULSD) containing aromatic hydrocarbon, or optionally a separate ULSD stream in addition to an ultra low sulphur aromatics stream. Accordingly, in one embodiment, the process disclosed herein is capable of providing a useable side stream containing in addition to sulphur free aromatic hydrocarbon, a separate stream of aqueous salts and/or sulphuric acid, thereby no or minimal HC (hydrocarbon) components are lost.

It will be appreciated that if the separated aromatic hydrocarbon is blended back with the ultra low sulphur hydrocarbon stream (ULSD), no hydrocarbon loss is experienced, however the ULSD will contain aromatics, some of which may be undesirable and indeed may require removal to comply with future and even present specifications imposing maximum total aromatics and/or maximum polyaromatics content of ULSD.

According to one embodiment of the process disclosed herein, sulphoxide and/or sulphones may be extracted from the oxidized hydrocarbon stream using sulphoxide/sulphone extraction techniques thereby producing a low aromatic ULSD stream in addition to a sulphoxide/sulphone stream. Such sulphoxide/sulphone extraction techniques include, but are not limited to, "liquid/liquid" extraction using polar solvents, "distillation" or "adsorption" using ion exchange techniques or a combination of techniques. Such techniques are well known and understood by those skilled in the art.

The extracted sulphoxide/sulphone stream can be treated to produce only low sulphur aromatic hydrocarbon and aqueous salts or sulphuric acid. This embodiment does not expose the complete oxidized hydrocarbon stream to the sulphone/sulphoxide conversion process, just the extracted sulphone/sulphoxide stream. The low sulphur aromatic stream can be used as a high value feedstock in the petrochemical industry. If specifications allow, this sulphur-free aromatic stream can be blended back into the ULSD stream. The salts can be used as a value added proposition, in much the same manner as the elemental sulphur produced by the desulphurization of light hydrocarbons using the well known and accepted combination of HDS and Clause processes.

A synoptical overview of one embodiment of the process disclosed herein is provided below. The stages as described are in functional order. Several embodiments of this basic process are described in more detail later. The process according to one embodiment comprises the following cascading stages:

1) First stage oxidation of hydrocarbon material containing electron rich sulphur compounds using N-chloroimide, Electrolyzed Oxidizing Water, catalyzed and co-catalysed hydrogen peroxide (as herein before described), hypochlorous acid or Hypobromous Acid as the primary oxidant or first stage oxidant.

2) Water wash oxidized hydrocarbon followed by organic/aqueous phase separation and extraction of polar oxidized sulphur compounds using polar liquid extraction solvent in a liquid/liquid extraction or ion exchange adsorption process.

3) Second stage oxidation using higher oxidation strength oxidants, either Hydroxyl Radical, Liquid Ferrate (Iron VI), or Hypofluorous Acid/Acetonitrile as the secondary oxidant. According to the second aspect disclosed herein, this second oxidation step may not be required and is dependent on the mass and species of sulphur in the feedstock (hydrocarbon material).

4) Water wash oxidized hydrocarbon followed by organic/aqueous phase separation and extraction of polar oxidized sulphur compounds using polar liquid extraction solvent in a liquid/liquid extraction or ion exchange process.

5) Separate oxidized hydrocarbon material (containing sulphoxides/sulphones) from said polar liquid extraction solvent using Vacuum Flash Distillation or equivalent techniques such as intense centrifuging for achieving said separation. This separation is typically used when using solvent extraction, however when using ion exchange adsorption, recovery of extracted compounds and regeneration of media is achieved by processes known and accepted by those skilled in the art.

6) Tertiary Oxidation of the separated oxidized hydrocarbon material sulphur compounds (containing sulphoxides and/or sulphones) to form two phases as a consequence of said oxidation. Said oxidation may be achieved through further oxidation of sulphoxides/sulphones to sulphites-using a tertiary oxidant selected from sodium hydroxide or hydroxyl radicals to produce sodium sulfite ($Na_2SO_3$), water and sulphur-free aromatic compounds when sodium hydroxide is used as the tertiary oxidant. When hydroxyl radicals are used for said tertiary oxidant, the sulphoxide/sulphone is oxidized to the sulphite$^-$ and hydrated to produce sulphuric acid ($H_2SO_4$) and sulphur free aromatic compounds. The separation of sulfides and otherwise lost hydrocarbon compounds (aromatics/aliphatics) provides a system to enable either the addition of sulphur free aromatic compounds back to the Ultra Low Sulphur Hydrocarbon stream or optionally provide sulphur free aromatic hydrocarbon compounds for use in industry, enabling a value addition to the owner of the said desulphurized hydrocarbon.

Oxidation and Oxidants

Oxidation of Sulphur Compounds Using Primary (Stage 1) and Secondary (Stage 2) Oxidants The process disclosed herein for reducing the sulphur content of a hydrocarbon material containing sulphur compounds, includes oxidation of sulphur containing compounds using one or more active oxidizers, being the first and/or second oxidants.

Embodiments of the process disclosed herein cater for a spectrum of feed stream sulphur compounds ranging from disulfides, and mercaptans, to the more challenging organosulphur compounds such as heterocyclic sulphur-containing compounds being thiophene, benzothiophene (BT), dibenzothiophene (DBT), 4-methyl-dibenzothiophene (MDBT), 4,6-dimethyl-dibenzothiophene (DMDBT) and methyl-dibenzothiophene. In one embodiment, a diverse range of feedstock comprising a total sulphur content ranging up to >20,000 ppm can be treated.

According to the disclosure herein, the primary oxidant will typically oxidize the electron rich sulphur compounds, as well as sulfides, disulfides and mercaptans which typically can allow oxidation of in excess of 50% of total feed stream sulphur. Accordingly, a consideration of the variation of mass and species of the sulphur containing compounds in the feedstock will be beneficial in determining whether use of the primary and/or secondary oxidant is required. This is an important attribute of the process disclosed herein, leading to increased flexibility of desulphurization capability of the process.

According to the first aspect, the primary oxidant has an oxidation reduction potential of up to 1550 mV and the secondary oxidant has an ORP of >1.55.

According to the second aspect, the process allows flexibility in oxidation with regard to which oxidant is used in relation to whether a primary and/or secondary oxidant is used.

In one embodiment of the first aspect and according to the second aspect, the primary oxidizer includes at least one member selected from the group consisting of:

a) N-chloroimide,
b) hypobromous acid,
c) electrolyzed oxidizing water
d) Hypochlorous acid
e) Catalysed and co-catalysed hydrogen peroxide and the secondary oxidant is selected from one or more of the group consisting of:

f) ferrate (Iron VI),
g) hypofluorus Acid,
h) chlorine dioxide,
i) hydroxyl radicals.

In another embodiment of the first and second aspects of the process disclosed herein, the primary oxidant typically is employed to oxidize the higher electron density compounds of sulphur (electron rich sulphur compounds), such as DMDBT and DBT, which are very amenable to exchanging or surrendering electrons which are readily absorbed by oxygen being subsequently substituted to the sulphur atom of the hydrocarbon molecules. This produces oxidized sulphur molecules in a two stage reaction; first reaction being sulphur oxidized to sulphoxide followed by the second reaction; that being sulphoxide oxidized to sulphone.

In certain embodiments, the choice of oxidants will be governed by factors such as the total sulphur content and the distribution and amounts of the various sulphur compounds in the feed stream and demographics of location The physical location of the plant has a considerable effect on the cost of transport if oxidizers which are not generated on site and need to be transported to a remote location, for example. These factors impact Op-Ex overheads.

If sulphur content is >1000 ppm of which there is a high percentage of benzothiophenes, it is unlikely that the primary oxidant alone will quantifiably oxidize said sulphur compounds. However the processes disclosed herein provide flexibility to treat a wide range of mass and species of sulphur.

The secondary oxidant is used to oxidize residual sulphur compounds which are relatively electron depleted and thus require a stronger oxidant or having higher electronegativity thereby being more capable of oxidizing such recalcitrant sulphur compounds.

Some feed streams have more difficult sulphur components to oxidise, more so than the aforementioned electron rich sulphur compounds. In order to oxidise more electron poor (low electron density) sulphur compounds which may be present in the hydrocarbon material, stronger oxidants, represented by the secondary oxidants are required. Defined as difficult is the comparative electron density on the sulphur atom, whereas, the electron density decreases in the following order; DMDBT>DBT>BT.

If the feed stream contains a large percentage of thiophenic compounds, the secondary oxidant, such as hydroxyl radical or Liquid Ferrate (Iron VI), will be required in addition to or in place of the primary oxidant. Electrolyzed oxidizing water can be a particularly useful option if the sulphur compounds are more sulfides, disulfides, mercaptans and high electron density organosulphur species.

The processes disclosed herein also incorporate several other options for the secondary oxidant. The second stage oxidant can also be stabilized hypofluorous acid or Liquid Ferrate (Iron VI).

The consideration of each plant's logistics and various locations including transport costs, dictate that if sodium hypochlorite or electrolyzed oxidizing water are used as the primary or secondary oxidants, the sodium hypochlorite or electrolyzed oxidizing water be generated on site using electrolysis of a brine solution technology known to those skilled in the art. In a preferred embodiment, the concentration of Free Available Chlorine (FAC) ranges from about 1% through to 14%. In situ oxidant generation may be advantageous as it allows a continual production of N-chloroimide oxidant which is the combination of sodium hypochlorite/water and cyanuric acid. This combination produces a relatively efficient oxidation media capable of oxidizing thiols and most disulfide compounds commonly found in hydrocarbon streams such as middle distillate, fuel oil and light fractions. In yet another embodiment, the processes disclosed herein encompass the use of a bromide oxidant, that being hydrobromic acid at concentration up to 60%, more typically 48%. The hydrobromic acid in this oxidant is electrolysed which as a consequence converts the bromide ion to bromine which when reacted with water, produces the active oxidant, hypobromous acid.

Catalysed and Co-Catalysed Hydrogen Peroxide

As indicated above, the catalysed and co-catalysed hydrogen peroxide can be hydrogen peroxide catalysed by catalysts selected from the group including but not limited to transition metals, noble metals and breakdown rate control catalysts (or decomposition catalyst); and co-catalysed by a Phase Transfer Catalyst (PTC).

The breakdown rate control catalysts (or decomposition catalyst) include but are not limited to phosphotungstic acid. The phosphotungstic acid can be formed from sodium tungstate dihydrate ($Na_2WO_4.2H_2O$) and phosphoric acid.

Typical PTC's are known to those skilled in the art and may be used as a co-catalyst in the process disclosed herein. The PTC may be selected from the group including but not limited to: quaternary ammonium salts including but not limited to quaternary ammonium hydrogen sulphates, such as tri-C8-10-alkylmethyl, hydrogen sulfates (e.g. Ultra C, CAS No 355009-64-2) and methyltrialkyl($C_8$-$C_{10}$)ammonium chloride (e.g. Adogen® 464 available from Evonik Industries) and N-Methyl-N,N-dioctyloctane-1-ammonium salts such as the chloride (e.g. Aliquat® 336 available from BASF); or equivalent PTC's known to those skilled in the art.

Ultra C ($C_8H_{17}$—$C_{10}H_{21})_3NCH_3^+HSO_4^-$, (CAS No 355009-64-2) can be prepared by modifying a chlorine based Adogen® compound (e.g. 464) and replacing the C1 with $HSO_4$. This can be achieved according to known techniques. The inventors have found that this modified PTC provides a marked increase in the efficacy of the PTC in the sulphur oxidation reaction when compared with using chlorine based PTC's such as Adogen® and Aliquat®.

In one embodiment, the primary oxidant is catalysed and co-catalysed hydrogen peroxide wherein the catalysed and co-catalysed hydrogen peroxide is hydrogen peroxide catalysed by phosphotungstic acid and co-catalysed with a phase transfer catalyst (PTC) comprising a Quartenary Ammonium Hydrogen Sulphate.

The present inventors have found that when hydrogen peroxide is used as a primary oxidant, then a catalyst and a co-catalyst are required to ensure quantitative oxidation of all sulphur compounds. In one embodiment, PTC is used as the co-catalyst when the process disclosed herein uses catalysed hydrogen peroxide as the oxidant. In another embodiment, phosphotungstic acid is the catalyst.

The present inventors have also found that changing the ratio between sodium tungstate dehydrate and phosphoric acid effects the oxidation of the sulphur containing compounds. Specifically, small increases in phosphoric acid has been found to aid qualitative sulphur oxidation. Without being bound by theory, the inventors believe that this is due to the additional protons which aids in electron exchange process (oxidation).

The inventors have found that without a co-catalyst such as PTC, the amount of hydrogen peroxide needs to be increased dramatically to the point that it is not viable to use. The inventors have found that even using about 10-20 times the stoichiometric amount of hydrogen peroxide and repeating the oxidation cycle up to 5 times did not quantitatively oxidise the sulphur compounds.

Without being bound by theory, the inventors believe that without the oxygen transfer attributes afforded by a quaternary ammonium hydrogen sulphate PTC, e.g. Ultra C, the reaction is not as efficient as oxygen migration between the organic and aqueous phase is kinetically limited without using PTC, resulting in excessive use of Hydrogen Peroxide and excessively long reaction time. The quaternary ammonium hydrogen sulphate PTC, e.g. Ultra C, provides an efficient oxygen mass transfer at the interface of the aqueous and organic layer.

N-Chloroimide

N-chloroimide can be produced by reacting sodium hypochlorite mixed with water and stabilized with an imide, such as cyanuric acid, succinimide, acetamide and piperidine. In one embodiment, the imide used is cyanuric acid. The sodium hypochlorite can be in a concentration range of from about 3% to 17.5% by weight, or from about 3% to 12% by weight, or from about 5% to 10% by weight.

The preparation of this oxidant is based on the premise that sodium hypochlorite reacts with imides such as cyanuric acid, succinimides and acetamide, to produce N-chloroimide. The said oxidant uses cyanuric acid as the imide in this invention, however any imide is suitable for N-chloroimide. The oxidant action in this invention is proposed as follows:

Sodium Hypochlorite reacts with the selected imide in the aqueous phase to produce N-chloromide, which transfers to the organic phase.

N-chloroimide oxidizes the sulphur compounds to produce sulphoxides and sulphones.

The N-chloroimide is prepared using the following recipe:
Sodium Hypochlorite@12.5% concentration=0.1553 mols
Cyanuric Acid=0.0052 mols.

The above oxidant was used to oxidize sulphur in a 1 gallon sample of diesel containing 500 ppm of sulphur. It is also noted that the recipe components may differ from those stated above and still produce a functional oxidant and therefore the invention using this recipe is not limited to the stated recipe.

Hypobromous Acid

According to the present invention, hypobromous Acid may be generated by either of two methods: i) Electrolysis of Hydrobromic Acid thereby producing bromine to which is added water to produce Hypobromous Acid; or ii) by reacting Hydrobromic Acid with water and Sodium Hypochlorite.

i) Electrolysis of Hydrobromic Acid

The production of hypobromous acid can be achieved by electrolysis of hydrogen bromide in water. It is known that the electrolysis of hydrogen bromide results in the transformation of the bromide ions to bromine which in the presence of water produces hypobromous acid. This technique is the preferred method of production of said hypobromous acid according to the process disclosed herein. This production method provides the ability to minimize the consumption of hydrobromic acid, because the bromide ion which is produced as a result of oxidation of the sulphur, is continuously electrolyzed by using standard electrolysis equipment, thereby forming bromine. Said manufacturing technique using electrolysis is well known to those skilled in the art.

In one preferred embodiment, electrolyzed hydrobromic acid is prepared by passing hydrobromic acid at 48% concentration through a Bromination Cell, whereby the electrolysis action transforms the Bromide ions to Bromine. Such cells are widely available and known to those skilled in the art. The Bromine produced at the anode of said cell is reacted with water to the point of saturation. The oxidant produced is hypobromous acid. As a result of oxidation of sulphur compounds the hypobromous acid is reduced to Bromide ions which are subsequently electrolysed as the cycle to produce hypobromous acid is reinitiated. This process is described herein as the in situ production of hydrobromous acid.

Accordingly, in one embodiment, hypobromous acid is prepared in situ by electrolysis of hydrogen bromide in water, wherein regeneration of bromine via electrolysis allows for recycling of the primary oxidant. In this embodiment, bromine is regenerated following oxidation of the sulphur containing hydrocarbon compound and reduction of the hypobromous acid to bromide ions which are then available for further electrolysis to form bromine and recycling in the process.

ii) Hydrobromic Acid with Water and Sodium Hypochlorite

This alternate strategy used to generate hypobromous acid is less preferred as the component chemicals in the oxidant are sacrificial. The major component chemical is sodium hypochlorite in the range of about 5% to 12.5% concentration mixed into a solution of hydrobromic acid at about 48% concentration and water and mixed until a pale yellow solution is achieved and a pH of 7 indicating that almost 95%-100% of the solution is hypobromous acid. This methodology remains an optional technique in the process disclosed herein for producing hypobromous acid, however the lack of ability to regenerate the oxidant (sodium hypochlorite) presents a cost of operation penalty. In this methodology, the oxidation of the bromide ion is carried out using Sodium Hypochlorite instead of using electrolysis to achieve the production of hypobromous acid.

The following recipe and procedure may be used according to one embodiment of the invention in the preparation of hypobromous acid:

Hydrobromic Acid @ 48% concentration=52.37 grams
Water=7,132 mls

Sodium Hypochlorite @ 12.5% concentration=246.16 grams.

The hypobromous solution recipe may be used to oxidize sulphur in a 1 gallon sample of diesel containing 500 ppm of sulphur. It is prepared by adding the said amount of water to a beaker containing said amount of hydrobromic acid whilst stirring continuously for up to 2 minutes. To this solution is added said amount of sodium hypochlorite, however this amount can vary depending on the colour and pH of the resultant solution. The optimum colour is a pale yellow and an optimum pH is between 6.8 and 7. After the preparation of this oxidant solution, it must be used within 5 minutes or less, preferably within 3 minutes of its preparation. It is also noted that the recipe components may differ from those stated above and still produce a functional oxidant and therefore the invention using this recipe is not limited to the stated recipe.

Hydroxyl Radicals

Hydroxyl radicals are chosen as a secondary oxidant due to its higher oxidation strength which is required to oxidize electron depleted sulphur compounds.

Hydroxyl radicals can be generated by passing humidified air preferably saturated, through a UV carrier catalysing titanium dioxide or similar catalyst. Such generators are now available and are known to those skilled in the art of advanced oxidation techniques.

In one embodiment, hydroxyl radicals are produced by the action of photolysis of humid air; said photolysis preferably being achieved by the radiation of humid air with UV light with an emission spectrum between 185 and 254 to 385 nm in conjunction with titanium dioxide ($TiO_2$/UV).

According to one embodiment, hydroxyl radicals are prepared on site using a hydroxyl generator.

In preferred embodiments, the generation of said hydroxyl radicals is done locally and as close as possible to the entry point of the oxidation reactor. To mitigate the risk of hydroxyl radical disassociation prior to entry to the oxidation reactor, the alternative option in this invention is to generate said hydroxyl radicals within the reactor. In one embodiment, the hydroxyl radicals may be generated by methods known by those skilled in the art of advanced oxidation process techniques. This can be achieved by using visible light with wave length from about 400 nm to 700 nm and adding visible light catalyst to the hydrocarbon such that light energy activates said catalyst thereby producing said hydroxyl radicals as oxidant. Visible light catalysts may be required because photon energy supplied by UV light is absorbed by any aromatics in the liquid hydrocarbon. This occurs in the UV light spectrum at wavelengths up to 380 nm, and the remaining UV portion of light up to 400 nm will provide inefficient and insufficient activation energy to use in such application.

In one embodiment, the method of generation is via UV/$TiO_2$ catalytic conversion of air containing moisture (humid air). Relative Humidity is preferred to be in the range of about 30% to 90%, more preferably about 40% to 80%, most preferably about 55% to 70%.

In one embodiment, the hydroxyl radicals are generated in situ by reacting humid air with titanium dioxide ($TiO_2$) catalysed by UV light with a wave length in the range of from about 185 nm-385 nm, or 254-385 nm, and in an hydroxyl radical generator, said technique known to those skilled in the art of advanced oxidation processes. The amount of hydroxyl radical used is preferably based on between 2.1 and 3 moles of hydroxyl radicals to oxidize 1 mol of sulphur. This stoichiometry is found to vary empirically and whilst not wishing to be bound by theory, it is supposed that the stoichiometry will vary according to the amount of oxidisable compounds and pH of the feedstock.

As noted above, hydroxyl generation may also be achieved by other techniques recognized by those skilled in the art of advanced oxidation processes (AOP), such as catalysing hydrogen peroxide with Fe++ compounds or UV radiation of Ozone or by reacting hydrogen peroxide with ozone, such as those methods listed below:

$O_3/H_2O_2$/UV $O_3$/UV $H_2O_2$/UV $H_2O_2/O_3$

In a preferred embodiment, the Hydroxyls are produced using a proprietary UV chamber in which Ti/$O_2$ coated air baffles were exposed to said UV light through which ambient air at about 70% humidity was passed at a rate of 2 SCFM. The flow calculation was based on the conversion of humidity in the air being about 70% thereby producing sufficient radicals to oxidize about 500 ppm of sulphur in the feed stream hydrocarbon. A stoichiometric rate of about 2 moles of oxidant to about 1 mol of sulphur was used as the basis of the amount of hydroxyls to be used to oxidize the sulphur at a feed rate of about 1 gallon/minute.

Electrolyzed Oxidizing Water

In one preferred embodiment, the electrolyzed oxidizing water is prepared off site and supplied by two manufacturers, using electrolytic techniques known to those skilled in the art. The electrolyzed oxidizing water samples used in oxidation trials ranged from ORP of 700 to 1200 and pH from 2.5 to 6.5. Trials were carried out using a volume ratio of 1:1 liquid hydrocarbon to electrolyzed oxidizing water in 1.5 gallons of liquid hydrocarbon. Reaction at ambient temperature was allowed to proceed for 15 minutes.

Stabilized Hypofluorous Acid

The secondary oxidant may be hypofluorous acid stabilized in a polar solvent such as acetonitrile. Stabilised hypofluorous acid in acetonitrile is the strongest electronegative compound in which a combination of fluorine and nitrogen is mixed. Preferably, the concentration of fluorine mixed with nitrogen does not exceed 20% by weight, preferably 15% to 20% more preferably 10% to 15% by weight, with the balance being nitrogen. In one embodiment the ratio of fluorine to nitrogen can vary between a mixture of 10% fluorine in 90% nitrogen and 20% fluorine and 80% nitrogen. This gaseous mixture is added to acetonitrile which stabilizes the oxidant. More specifically, the oxidant is prepared by bubbling the reduced fluorine concentration gaseous mixture comprising fluorine and nitrogen into liquid acetonitrile to form HOF.$CH_3CN$ electrophilic oxidant.

Hypofluorous acid mixed and stabilized in acetonitrile is described in the writings by it's pioneer Shlomo Rozen. It was discovered by Rozen et al that this stabilized hypofluorous acid in Acetonitrile solution thereby producing a stable solution of HOF.$CH_3CN$, has the best ability to oxidize numerous compounds where Acetonitrile acted as an oxygen transfer agent. The oxidizing power of this solution is not dissolved fluorine and it is not the source of electrophilic fluorine, but is actually the source of an electrophilic oxygen atom. It is therefore known that the oxidant is a complex between the very unstable HOF hypofluorous acid and therefore not very useful, and aqueous acetonitrile. The complex comprises HOF mixed with 1 mole equivalent of acetonitrile. The acetonitrile solvent complex producing the above referenced oxidant, contains water at a minimum content in Acetonitrile of 10%.

According to the present invention, hypofluorous acid is preferably prepared according to the following recipe:

For 1 gallon of diesel containing 500 ppm of sulphur, the following recipe was used Fluorine @ 20% in Nitrogen=0.000228 moles (0.00865 grams)

Acetonitrile @ 90% and water @ 10%=1 mol equivalent of HOF.

Mixtures of fluorine/nitrogen are readily available from commercial suppliers such as Air Products and Linde, however the preferred methodology for production of hypofluorous acid is to use on site fluorine generators as manufactured and supplied by companies such as Linde.

Liquid Ferrate (Iron VI).

The secondary oxidant liquid ferrate (Iron VI) can be used alone or in conjunction with chlorine dioxide, preferably in gas phase and at a concentration of up to 10% in air or Nitrogen. In a preferred embodiment, liquid ferrate (Iron VI) is generated on site using a proprietary process. The liquid ferrate Generator is used in the same manner as other liquid oxidants and at the same reaction conditions and changed stoicheometric conditions; that being the oxidation stoichiometry varies to accommodate the Fe IV oxidizing capacity of 2200 mV where Ferrate is reacted in an oxidation reactor at a rate of about 0.67 mols of Ferrate per 1 mol of sulphur for a time of less than about 5 minutes at a temperature of up to about 25° C. at a pH in the range of about 7 to 8. Pressure conditions do not vary from those of optional secondary oxidants.

Gaseous Chlorine Dioxide

The secondary oxidant can be chlorine dioxide preferably as gas diluted to <10% concentration in air or nitrogen. In one embodiment, the gaseous chlorine dioxide is produced on site using chlorine dioxide generators known to those skilled in the art. Chlorine dioxide, is considered to be a relatively strong oxidant due to its available 5 electrons which form the basis of oxidation caused by electron transfer and subsequent oxygen substitution on the sulphur molecules. In one embodiment, the chlorine dioxide stoichiometry used is as follows:

For oxidation of a 1 gallon sample of diesel containing 500 ppm sulphur;

Chlorine Dioxide=0.0129 mol.

DETAILED DESCRIPTION OF SPECIFIC EMBODIMENT

In one embodiment of the process disclosed herein for reducing the sulphur content of a liquid hydrocarbon material containing sulphur compounds, the process comprises:

At least one oxidation step initially optionally followed by a second oxidation step comprising rapid mixing of the hydrocarbon material with a primary and secondary oxidant as hereinbefore described, in at least a stoichiometric amount for a time and under conditions sufficient to convert sulphur compounds to a sulfoxide and/or a sulphone and thereby produce oxidized-sulphur-containing-hydrocarbon;

at least one extraction step preferably using a flow through magnetic filter with a magnetic field of at least 11,000 Gauss, after said oxidation steps. Said magnetic filtration attracts polar sulphoxides/sulphones thereby substantially extracting polar compounds from the hydrocarbon stream. An additional polishing step following said magnetic filtration comprising contacting any remaining oxidised-sulphur-containing-hydrocarbon with an Ionic Liquid (IL) or aqueous polar extraction solvent such as Acetonitrile or y-butyrolactone (GBL) or by contacting said oxidized sulphur compounds through adsorption columns loaded with ion exchange media, MOF (Metal Organic Framework) such as Basolite® ($C_{18}H_6Cu_3O_{12}$—Copper Benzene-1,3,5-Tricarboxylate), Selexsorb® Metal Oxide Purification Adsorbent group of adsorbents, $CuC_{12}$MIL-47 MOF, Zeolite, Molecular Imprinted Chitosan or Activated Carbon. Said contact is required for a time and under conditions sufficient to allow at least any remnant portion of the oxidized sulphur to be extracted into the IL or aqueous extraction solvent or adsorbed by ion exchange material or adsorption media as described. Said contact with either extraction solvent or adsorption will extract remnant polar compounds to give loaded IL or loaded aqueous extraction solvent or ion exchange/adsorption columns, and hydrocarbon of reduced sulphur content;

separating the loaded IL or y-butyrolactone, acetonitrile loaded aqueous extraction solvent or adsorbed ion exchange media from the hydrocarbon of reduced sulphur content to give hydrocarbon of reduced sulphur content.

It is possible that when IL is used as the optional polar liquid extraction solvent and the loaded IL is separated from the hydrocarbon of reduced sulphur content, remnants of IL may still be left in the hydrocarbon of reduced sulphur content which may be undesirable in some cases. This only pertains to the use of IL as the polar extraction solvent, however the typical extraction and polishing of polar compounds can be Ion Exchange/Adsorption media whilst liquid extraction solvent options in the present invention are Acetonitrile or y-butyrolactone are viable alternatives. Whilst IL remains an option, if said IL is used the following scenario is valid.

Accordingly, a preferred embodiment of the process disclosed herein may further comprise:

at least one water wash/polish step comprising contacting the hydrocarbon of reduced sulphur content with water for a time and under conditions sufficient to allow any remaining extraction solution in the hydrocarbon of reduced sulphur content to be absorbed by the water; and separating the water from the hydrocarbon to give a hydrocarbon of reduced sulphur content.

The hydrocarbon material can be a liquid hydrocarbon material. Examples of liquid hydrocarbon materials include diesel, fuel oil, jet fuel feedstock, natural gas condensate, kerosene, naphthalene, vacuum gas oil and fuel oil.

The amount of oxidizer can be in a near stoichiometric amount for the conversion of sulphur compounds to sulphoxides and/or a sulphones, the theoretical amount being 2 mols of oxidant per mol of sulphur. In one embodiment, about two to four mol equivalent of oxidiser is added per mol equivalent of sulphur. Greater excess of oxidizer is typically unnecessary and not economically desirable. In this embodiment, the process comprises two oxidation steps. The first oxidation step is used to oxidize the electron rich sulphur compounds, whilst the second oxidation step is required to oxidize electron deprived sulphur compounds.

After said first oxidation step, water washing and sulphoxide/sulphone extraction follows as per the following description. The substantially sulphur free hydrocarbon stream which has undergone the first stage oxidation, water wash which is not required if hydroxyl radicals are used for said oxidation process, and extraction, is then exposed to the second stage oxidation step, water washing and extraction. After each oxidation/water wash and extraction stage, the aqueous and organic phases are separated using coalescence, OSN membrane (organic solvent nanofiltration) or similar phase separation techniques known to those skilled in the art.

The process disclosed herein may also optionally comprise a pre-mixing step prior to the first oxidation stage, in which the hydrocarbon material and oxidizer are fed into a static mixer prior to rapid mixing in the Agitated Column, Cavitation or Shear Film type reactors.

The rapid mixing of the hydrocarbon material and oxidizer can be carried out by contacting both organic and aqueous/gaseous phases in an Agitated Column, Cavitation or Shear Film Reactors, with residence time of up to 15 minutes. Rapid mixing is achieved by up to five impeller stages within the column. The working principles and design of these type mixer/reactors are well known by those skilled in the art. This mixing causes the oxidant to react due to electron exchange. The electron rich sulphur compounds exchange electrons with the oxidant causing an oxygen substitution on the sulphur thereby oxidizing the sulphur molecule.

Whilst not being bound by the theory the apparent initial oxidation reaction in stage one oxidation reaction is very quick and stage one occurs when atomic oxygen is bonded to the sulphur compounds due to the release of an electron from the sulphur compounds to the first stage oxidant. Without being bound by theory, the inventors believe that oxidation rate, more specifically electron transfer, is dependant upon the relative electron status of the sulphur compounds and the relative strength of the oxidant.

Rapid mixing of liquid hydrocarbon and oxidant phases is provided by PI (Process Intensification) reactors such as Film Shear, Membrane Contactor, Ultrasonic or Cavitation Reactors or by Counter/Cocurrent Agitation Column or equivalent Reactors at temperatures in the range of about 20° C. (68° F.) to 70° C. (158° F.) and pressure in the range of about 140 kPa (20 PSI) to 350 kPa (50 PSI), that is able to be achieved in the said type reactors, results in oxidation of the sulphur compounds in the hydrocarbon material to proceed in the absence of an oxidation transfer facilitator (PTC—Phase Transfer Catalyst) or a catalyst required when using some prior art oxidants. Catalysts are required to control the decomposition rate of oxidant, thereby allowing sufficient time to achieve contact and oxidation. Whilst mass contact between the oxidant and organic phase is necessary neither of the oxidants used in the first stage oxidation, requires additional catalysts, with the exception of the combination hydrogen peroxide/phosphotungstic acid/Phase Transfer Catalyst. This rule also applies to the second stage oxidation process using the second stage oxidants encompassed in this invention.

It will be appreciated that the pressure, temperature and reactor shaft speed sufficient to oxidize the sulphur in compounds will vary with the sulphur compounds present in the hydrocarbon feedstock. Refractory electron depleted sulphur compounds that may be present in the feedstock include but are not limited to, thiophenes, benzothiophenes, alkylated benzothiophenes, dibenzothiophene and sterically hindered alkylated dibenzothiophenes. Rapid mixing in the reactor at temperatures in the order of about 20° C. (68° F.)-70° C. (158° F.) and pressure in the range of 140 kPa (20 PSI)-350 kPa (50 PSI) are generally suitable. Reactor shaft speed controlled by VFD (Variable Frequency Drive) of between 300 and 2400 RPM are also suitable at these temperatures and pressures.

The process disclosed herein includes one or more extractions with an Ionic Liquid (IL) or an alternate aqueous extraction solvent. The aqueous extraction solvent may be brine or water and is preferably water. The pH level of the extraction water may vary between 6.5 and 7.5. The oxidized-sulphur-containing-hydrocarbon may be contacted with an IL or other polar extraction solvents, such as Acetonitrile or previously identified extraction solvents either directly after oxidation or optionally after a water extraction step. The hydrocarbon may be subject to multiple IL or Acetonitrile extractions and multiple water washes.

The step of contacting the hydrocarbon material with the primary and/or secondary oxidant can be conducted prior to contacting with the extraction solvent. However if the feedstock hydrocarbon has high olefin content, the extraction solvent can be contacted with the feedstock hydrocarbon, prior to the oxidation stage. This is primarily to lower the amount of oxidant, which is required due to the diene content, as such components tend to scavenge the oxidant prior to the sulphur being oxidized. This is not normally a problem when treating diesel, either straight run or cracked, but in some Transmix hydrocarbon, this could be a possibility.

When the hydrocarbon material comprises naphtha or a gasoline fraction or other fractions which contain dienes, the step of contacting the hydrocarbon material with the oxidant may be conducted after an initial extraction of the naphtha or other hydrocarbon fractions with an ionic liquid or other polar extraction solvent such as Acetonitrile in order to selectively remove dienes which may otherwise deactivate or impede the oxidation step.

The extraction solvent can be an IL of the general composition $Q^+A^-$, where $Q^+$ is a quaternary ammonium or phosphonium cation and $A^-$ is an inorganic or organic anion, selected such that the IL is in a liquid state at the operating temperature and pressure of the process. More specifically, the ionic liquid can have a $Q^+$ cation selected from an alkyl pyridinium cation, an alkyl pyrrolidinium cation, an alkyl piperridinium cation, a di-alkyl imidazolium cation, a tri-alkyl imidazolium cation, a trialkyl piperazinium cation, a tetra-alkylphosphonium, a tetra-alkylarsonium, a tetra-alkylantimonium and a tetra alkyl ammonium cation, and a $A^-$ anion selected from the group consisting of a halide anion, nitrate anion, alkylsulfate anions, alkylsulfonate anions, alkylsubstituted aryl sulfonates such as the p-toluene sulfonate anion or the perflurinated derivatives of these anions, a alkylphosphosphate anion, a alkylphosphonate anion, a alkylphosphinate anion or the per fluorinated alkyl derivatives of these phosphorus based anions, carboxylate anions or the perfluorinated carboxylate anions, a thiocyanate anion, a hexafluorophosphate anion, a tetrafluoroborate anion, dicyanamide anion, a bis(trifluormethanesulfonyl) imid anion, a halogenoaluminate anion, an organohalogenoaluminate anion, and mixtures thereof.

Preferably, the IL is selected so it has a miscibility gap when in contact with the hydrocarbon phase sufficient to minimise undesired losses of hydrocarbon from the hydrocarbon phase into the ionic liquid phase and losses of the IL extraction solvent into the hydrocarbon phase. It is also preferable that the selected ionic liquid has a miscibility gap when in contact with the hydrocarbon phase sufficient to minimise settling times for phase separation and dispersion of the ionic liquid into the hydrocarbon phase. It is further preferable that the IL is selected in a manner which allows for a maximum solubility of unoxidized and oxidized sulphur compounds and other contaminants of the hydrocarbon phase such as organonitrogen compounds in reduced and oxidized form.

Alternate polar solvents such as Acetonitrile, Dimethyl Fumerate (DMF), Dimethyl Sulfoxide (DMSO), Furfural or Methanol are suitably polar and may be used. The major drawback of this last group of polar extraction solvents is that with the exception of Acetonitrile, they are more difficult to regenerate. The other drawback of strong polar extraction solvents is that the aromatics of which the said sulphur is a portion, are removed as the complete molecule. As an example, dibenzothiophene sulphur is oxidized, therefore polarized by the results of oxidation which converts said sulphur to dibenzothiophene sulfoxide and/or dibenzothiophene sulphone. The extraction process removes the dibenzothiophene sulphone completely. The process disclosed herein negates this problem by incorporating an additional processing step which separates the aromatic hydrocarbon from the oxidized sulphur, thereby producing a stream of substantially low sulphur aromatic hydrocarbon and a stream of aqueous sodium sulfite or sulphuric acid, depending on the choice of tertiary oxidant. If hydroxyl radicals is the oxidant used, the separated sulphone ($SO_2$) will be oxidized to $SO_3$ and hydrated to form sulphuric acid, however if a caustic (NaOH) solution is used, sodium sulphite will be produced.

The sulphoxide/sulphone extraction from oxidized hydrocarbon may be conducted at temperatures ranging from 30° C. (86° F.) to 100° C. (212° F.) and pressure ranging from atmospheric to 50 psi (350 kPa). For removal of more complex sulphur compounds, more elevated temperatures and pressures may be beneficial. Extraction into water may, for example, be conducted up to the boiling point of water at a given pressure. A person skilled in the art would appreciate that for a volatile hydrocarbon, such as a natural gas condensate, an increase in pressure will be required under elevated temperatures to keep the NGC in the liquid phase.

The ratio of hydrocarbon to extraction solvent can be about 10:1 or higher, or about 8:1, or about 5:1. Smaller ratios are also viable; however, with smaller ratios the cost of the extraction solvent for the process will be commensurately higher.

The process of the present disclosed herein is suitable for reducing the sulphur content of a range of hydrocarbon materials including natural gas condensates, light oils, diesel hydrocarbon, kerosene and naphtha, reconstituted hydrocarbon from waste oil, jet fuel, fuel oil and products of coal gasification and liquefaction. The process has been found to be highly effective when used on hydrocarbons from actual oil refinery streams. Such hydrocarbons contain a variety of sulphur compounds of varying complexity and resistance to oxidation, depending on the source. Sulphur compounds identified and successfully treated in NGC and diesel streams are identified in Sulphur speciation documents displayed later in this disclosure. This is in strong contrast to laboratory hydrocarbon model compositions which may include only limited selected sulphur compounds and where the limited selected composition of hydrocarbons impacts on the effectiveness of the process.

The extraction solvents that can be used in embodiments of the process disclosed herein, either IL or other nominated polar solvents, can be separated and regenerated from the S-compounds in a simple manner by distillation techniques, or via OSN membrane technologies thus avoiding large volume waste streams and also allows for economic operation.

The process disclosed herein can include an additional extraction stage which is used to polish any minor amounts of sulphur which has not been quantitatively oxidized and extracted. In one embodiment an adsorption stage is incorporated in which sulphur molecules are physically or physically/chemically adsorbed into the adsorbent surface. Such techniques are known to those skilled in the art of adsorption. A variety of adsorbents applies to this invention including GAC (Granular Activated Carbon) Zeolite, Cu Impregnated Chabazite, Fuller's Earth, Molecular Imprinted Chitosan and Molecular Sieves such as the range of Selexsorbs® by BASF or their equivalents and the very efficient variety of MOF's (Metal Oxide Frameworks) such as the Basolite® range of MOF's by BASF or their equivalents. In a preferred embodiment of this invention MOF type adsorbents are preferred due to their superior adsorbance capacity which is some 6 to 8 times higher than Zeolite or Activated Carbon.

Substantially lowered sulphur containing liquid hydrocarbon which has been treated using the aforementioned oxidation and extraction process is passed through said adsorbent column, whereby one column is actively adsorbing whilst the other column is undergoing stripping of adsorbed sulfur species. Said stripping is achieved using Nitrogen under vacuum and heated to between 100° C. (212° F.) and 200° C. (392° F.). Such stripping and regenerating techniques are well known by those skilled in the art.

It is recognized that in the oxidation process that the sulphur molecule undergoes oxidation of the sulphur atom and produces sulphoxides and/or sulphones as a result. It is then recognized that the polar extraction or adsorption stages remove the complete molecule of oxidized sulfur thereby removing minor amounts of hydrocarbon (HC). This potential HC is relative to the amount of sulfur in the hydrocarbon feed to be desulphurized. For example Dibenzothiophene ($C_{12}H_8S$) is oxidized to Dibenzothiophene Sulphoxide ($C_{12}H_8SO$) and Dibenzothiophene Sulphone ($C12H_8SO_2$) wherein this complete molecule is extracted or adsorbed from the liquid hydrocarbon stream. It is desirable to further recover the HC component of said sulphone molecule to avoid excessive losses of hydrocarbon, more particularly relevant when feed streams to be desulphurized have ever increasing amounts of sulphur in said streams.

In one embodiment of the process disclosed herein, an extra processing stage may be incorporated to recover the HC component of the sulphoxide and/or sulphone. For example for said dibenzothiophene ($C_{12}H_8S$), the $C_{12}H_8$ may be recovered as a low sulphur aromatic component and depending on total aromatic level as specified, said component can be either blended back with the ultra low sulphur stream or be available as a valuable low sulphur aromatic.

An important feature of the process disclosed herein is the additional stage whereby said sulphoxides and/or sulphones are further oxidized by either sodium hydroxide or Hydroxyl Radicals. The sulphoxide/sulphone stream recovered via the extraction and/or adsorption processes, can be reacted with Sodium Hydroxide solution at a concentration, of about 45% to 55%, or about 49% to 52%. The inventors have found that at a sulphone to Sodium Hydroxide volumetric ratio of about 1:1 and at a temperature in the range of about 45° C. (113° F.) to 75° C. (167° F.), more or about 50° C. (122° F.) to 65° C. (149° F.), or about 55° C. (131° F.) to 60° C. (140° F.), being agitated for a period (residence time) of about 12 minutes, or about 10 minutes, or up to about 8 minutes, produces up to almost quantitative removal of the sulphur in the form of aqueous sodium sulfite.

As an alternate method of recovery of sulphoxides/sulphones, hydroxyl radicals can be used. Hydroxyl radicals as used in aforementioned second stage oxidant, may be reacted with said sulphoxides/sulphones at a molar ratio of 1 to 4 moles of hydroxyl radical to 1 mole of sulphone. The preferred stoicheiometry is 2 moles of hydroxyl radicals to 1 mole of sulphoxide/sulphone. If sulphoxide is being oxidized the higher stoicheiometry will apply. Said reaction is carried out in a reactor as described in the oxidation reaction, but reaction is slow unless optional catalysts are used. Said reaction can take about 10 to 20 minutes at temperature up to about 75° C., or about 70° C., or about 65° C. The addition of water produces sulphuric acid, where the ($SO/SO_2$)

component of sulphoxides/sulphones is oxidized to $SO_3$, thereby forming sulphuric acid upon hydration.

Therefore in at least one embodiment, the process of the present invention for the reduction of S-levels in liquid HC (hydrocarbons) may be operated in a simple and economically viable manner with very low and easy to handle waste streams.

MODES FOR CARRYING OUT THE INVENTION

The process disclosed herein will now be further described by way of embodiments which are intended to be illustrative only and not restrictive.

FIG. 1

FIG. 1 shows a general scheme for one embodiment of the process disclosed herein. In this embodiment, initial sulphur content of a hydrocarbon feedstock is measured (Sulphur Analyser A), item 1 on FIG. 1. The hydrocarbon feedstock is heated, if required and prior to delivery to the process battery limit to a temperature in the range of about 30° C. (86° F.) to 65° C. (149° F.) and introduced at a pressure in the range of about 140 kPa (20 PSI) to 350 kPa (50 PSI) into the primary oxidation reactor item 2. The primary oxidant may be either of the oxidants:

N-chloroimide
Hypobromous Acid
Electrolysed Oxidising water
Catalyzed and co-catalysed Hydrogen Peroxide or
Hypochlorous Acid as hereinbefore described.

Either of the primary oxidants (stage 1 oxidant) as described above is introduced at the same time as the liquid hydrocarbon material and at a temperature in the range of about 20° C. (68° F.) to 30° C. (86° F.). The amount of introduced oxidant is proportionally metered in at a rate equivalent to about 2 moles to 4 moles of oxidant to 1 mol of sulphur as detected by the on-line Total Sulphur Analyzer (A) item 1 on FIG. 1. This oxidant is sufficient to oxidise the sulphur compounds in the hydrocarbon feedstock to sulphoxides and/or sulphones. The said oxidizer may be introduced to an agitated column, or Film Shear Reactor of Membrane Contactor Device or equivalent reactor 2 on FIG. 1. The reactor residence time is designed to be in the range of about 100 seconds to 380 seconds, in some cases about 80 seconds to 320 seconds, and in other case preferably about 60 seconds to 300 seconds.

After mixing the hydrocarbon and oxidant, the resultant oxidation reaction occurs in said reactor 2, and the hydrocarbon/sulphone solution is introduced to a separator item 3 as displayed on FIG. 1. This separator which can be either a coalescing or centrifugal or electrostatic type, separates the water which has been released from said reactor. Water is the aqueous component of oxidants as described previously, however when hydroxyl radicals are used as the oxidant, this aqueous component is the residual humidity contained in the air and is up to 85% of the moisture, which is not converted into to Hydroxyls in the aforementioned on site hydroxyls generator. If any other aforementioned primary oxidant is used, the water contained in each of those oxidant is separated in the same manner, but it will be appreciated that the amount of water coalesced from the oxidized hydrocarbon, will vary according to the stoichiometry ratios and water content of the oxidant.

The sulphones are created by the oxidation of sulphur compounds, this being achieved essentially by the action of atomic oxygen bonding to sulphur to form the sulphone. This process is afforded in a two step dynamic reaction, which is described above.

The sulphone laden hydrocarbon is then introduced at a temperature in the range of about 30° C. (86° F.) to 65° C. (149° F.) and at a pressure in the range of 140 kPa (20 PSI) to 350 kPa (50 PSI) to an agitated column, or Film Shear Reactor of Membrane Contactor Device or equivalent reactor 4 on FIG. 1, where water is introduced at temperatures in the range of about 30° C. (86° F.) to 65° C. (149° F.) to polish out any residual oxidant. By volume, the amount of water can range from about 50% to 100% of the volume of hydrocarbon. The reactor residence time is designed to be in the range of about 5 seconds to 90 seconds, in some cases about 10 seconds to 30 seconds, and in other cases about 5 seconds to 20 seconds.

The water washed hydrocarbon is then introduced to separator 5 on FIG. 1. This separator which can be either a coalescing or centrifugal or electrostatic type separates the water from the liquid hydrocarbon exiting reactor 4 which can contain very small amounts of muriatic/citric acid, from the sulphone laden hydrocarbon.

The substantially water free sulphone laden hydrocarbon exiting separator 5 on FIG. 1, is then introduced to reactor 6 on FIG. 1, where the polar extraction solvent is also introduced. The sulphone laden hydrocarbon is introduced at a temperature in the range of about 30° C. (86° F.) to 65° C. (149° F.) and at a pressure in the range of about 140 kPa (20 PSI) to 350 kPa (50 PSI), where the polar extraction solvent is introduced at temperatures in the range of about 30° C. (86° F.) to 65° C. (149° F.) to extract or absorb the polar oxidized sulphur compounds or sulphones. The extraction solvent by volume can range from 20% to 75% of the volume of hydrocarbon. For economic reasons this amount is to be kept to a minimum expected to be circa 30% to 35%. The reactor residence time is designed to be in the range of about 25 seconds to 90 seconds, in some cases about 20 seconds to 30 seconds, and in other cases about 15 seconds to 20 seconds.

Following the sulphone extraction process accomplished in reactor 6, the sulphone stream which is embedded in the polar extraction solvent, is separated from the substantially sulphur free hydrocarbon via separator 7 on FIG. 1. This separator may be, for example, either a coalescing or centrifugal or electrostatic type.

Following the separation of the sulphone rich extraction stream from the substantially sulphur free hydrocarbon, the sulphone rich stream may be distilled in the distillation unit 14 on FIG. 1. Distillation, nano filtration, membrane contactor or RO techniques may be used to recover the extraction solvent and provide a concentrated sulphone stream. The distillation and separation techniques are well known to those skilled in the art, and distillation characteristics will be determined by the selected extraction solvent's boiling point.

The substantially sulphur free hydrocarbon stream exiting separator 7 on FIG. 1 is then introduced to reactor 8 on FIG. 1. The sulphone extracted hydrocarbon is introduced at a temperature in the range of about 30° C. (86° F.) to 65° C. (149° F.) and at a pressure in the range of about 140 kPa (20 PSI) to 350 kPa (50 PSI), where any residual polar extraction solvent is washed out from the hydrocarbon. Water is introduced to reactor 8 on FIG. 1 at temperatures in the range of about 30° C. (86° F.) to 65° C. (149° F.) and at a pressure in the range of about 140 kPa (20 PSI) to 350 kPa (50 PSI) to polish any extraction solvent remaining in the sulphone extracted hydrocarbon stream exiting from separator 7. The wash/polish water by volume can range in an amount of 20% to 75% of the volume of hydrocarbon. The reactor residence time is designed to be in the range of about 25 seconds to 90 seconds, in some cases about 20 seconds to 30 seconds, and in other cases about 15 seconds to 20 seconds.

Following the water washing and hydrocarbon polishing process accomplished in reactor 8 on FIG. 1, the hydrocarbon phase is introduced to separator 9 on FIG. 1, where the Ultra Low Sulphur Hydrocarbon is separated from the polishing water to exit separator 9 on FIG. 1 as treated and sulphur free hydrocarbon. The polishing water is separated and becomes used water. The sulphur free hydrocarbon exiting separator 9 on FIG. 1 is then subjected to a polishing stage, which removes any sulfones which may have been left in the water washed hydrocarbon exiting reactor 8 on FIG. 1.

The polishing stage consists of two adsorbent laden columns items 10 and 11 on FIG. 1. One column is in "adsorption" mode whilst the other is in 'desorption" mode. In adsorption mode the sulphur free hydrocarbon is directed to the column designated at that instant as being in adsorption mode, which is charged with media consisting of either of the following adsorbents;

Y-Zeolite

Activated Carbon

MOF (Metal Organic Framework) adsorbents such as but not restricted to $CuCl_2$MIL-47 (Material of Institute Lavoisier) or BASF product line of Basolite® C300 ($C18H6Cu_3O_{12}$), Cu impregnated Chabazite or Fullers Earth.

The adsorbent material acts as a physiochemical extraction system in which any remaining sulphur compound, whether oxidized or not oxidized, is adsorbed into the adsorbent media's structure. The preferred adsorption cycle is 24 hours, after which the adsorbent must undergo desorption via the injection of $N_2$ at a temperature sufficient to vaporize and strip the adsorbed sulphur compounds under a vacuum. The temperature is above the boiling point of any retained sulphur compound. This can exceed about 250° C. (482° F.) at atmospheric pressure but under vacuum will be substantially lower temperature as will be appreciated by those skilled in the art. The hydrocarbon is redirected to the other identical column which at that time is in adsorption mode whilst the previous adsorption mode column switches to desorption mode. The desorption cycle is designed to be exposed to the $N_2$ stripping or desorption mode for up to about 4 hours, more preferably about 3 hours, most preferably about 2 hours after which said column is in a standby mode awaiting for the cyclic change back to adsorption mode. During the adsorption cycle on both columns 10 and 11, the hydrocarbon stream exiting said columns is a sulphur free hydrocarbon and if said hydrocarbon is a diesel cut, the resultant exit stream will be ULSD (ultra low sulphur diesel).

If the hydrocarbon exiting from either column 10 or column 11 has not satisfied the sulphur reduction target as measured by the on line Total Sulphur Analyzer A item 15 on FIG. 1 installed at the treated hydrocarbon process exit, the "off specification" hydrocarbon stream will be automatically diverted to the primary oxidation reactor 2 on FIG. 1, for reprocessing.

Purged or stripped sulphur species and $N_2$ exiting either column 10 or column 11, depending on which column is in desorption mode, is cooled to a temperature nominally about 50° C. (122° F.) via conventional heat exchanging in heat exchanger item 12 on FIG. 1. This cooled stream exiting the heat exchanger item 12 is directed to a degasser membrane or coalescer item 13 on FIG. 1, where separated $N_2$ is vented or recycled and sulphur compounds (typically sulphoxides and/or sulphones) are directed to Tertiary oxidation.

Tertiary oxidation is carried out in reactor item 16 on FIG. 1. Said reactor is identical to aforementioned oxidation reactors. The sulphoxide/sulphone stream which is the combination of stripped sulphur compounds from adsorption columns 10 and 11 on FIG. 1 and residue resulting from the distillation or separation of the extraction solvent from the sulphones in the distillation unit 14 on FIG. 1, is introduced to reactor 16 on FIG. 1. It is introduced at temperatures in the range of about 30° C. (86° F.) to 65° C. (149° F.) and at a pressure in the range of about 140 kPa (20 PSI) and 350 kPa (50 PSI). Introduced to reactor 9 is also a caustic solution at a concentration of about 5% to 70%. This is introduced at temperatures in the range of about 40° C. (104° F.) to 80° C. (176° F.) and at a pressure in the range of about 140 kPa (20 PSI) to 350 kPa (50 PSI). This stage of the process is very important and is used to separate the sulphur free aromatic hydrocarbon component of the sulphone from the sulphone component. The sulphone component is converted to Sodium Sulfite solution ($Na_2SO_3$+$H_2O$) per the following chemistry:

$$R—SO_2+2NaOH \rightarrow Na_2SO_3+R+H_2O$$

The sulphur free aromatic hydrocarbons designated as "R" in the aforementioned chemistry resulting from the reaction in reactor 16 is introduced to separator 17 on FIG. 1 where the aromatic hydrocarbon components are separated from the sodium sulfite solution. This separator is preferably either a coalescing or centrifugal or electrostatic type or equivalent membrane separation device.

The ultra low sulphur (ULS) aromatic stream exiting separator 17 on FIG. 1, is introduced to reactor 18 on FIG. 1 at temperatures in the range of about 40° C. (104° F.) to 80° C. (176° F.) and at a pressure in the range of about 140 kPa (20 PSI) to 350 kPa (50 PSI). Water is preferably introduced simultaneously into reactor 18 at temperature in the range of about 40° C. (104° F.) to 80° C. (176° F.) and at a pressure in the range of about 140 kPa (20 PSI) to 350 kPa (50 PSI). The residence time in this reactor is in the range of about 20 seconds to 60 seconds, preferably about 15 seconds to 30 seconds. This stage is added to water wash the aromatics stream, thereby polishing any residual caustic out of the aromatics stream.

The water washed aromatics stream exiting reactor 18 is then introduced to separator 19 on FIG. 1, where residual caustic solution is removed, thereby producing ultra low sulphur aromatics and a low concentrate sodium sulfite raffinate. The water washed aromatic stream is a potentially valuable by-product with uses in multiple industrial applications, known to those skilled in the art. Most importantly, there is very low loss of valuable aromatics hydrocarbons and the sulphur is not in the form of high availability elemental sulphur, but in a sodium sulfite solution, which could be dehydrated if required.

If particular locations do not have onerous limitations on either or both Total Aromatics or PAH, the sulphur free aromatics can be blended back into the Ultra Low Sulphur Hydrocarbon stream exiting from adsorption columns 10 and/or 11 on FIG. 1.

Oxidation Using Catalysed and Co-Catalysed Hydrogen Peroxide

In one embodiment according to the first and second aspect of the process described herein, only a primary oxidant is used. In one preferred embodiment, the primary oxidant is a catalysed and co-catalysed hydrogen peroxide, preferably hydrogen peroxide catalysed by phosphotungstic acid resulting from a mixture of Sodium Tungstate Dihydrate and Phosphoric Acid and co-catalysed by a PTC, preferably Ultra C.

Oxidative desulphurisation is performed at slightly above atmospheric conditions (about 60-65° C.) using a mixture of hydrogen peroxide, tungstate to regulate the decomposition of the hydrogen peroxide and phosphoric acid to protonate the diesel (so that it is slightly acidic) and PTC for oxidation efficiency due to the oxygen transfer from the aqueous phase to the organic phase. After oxidation the diesel is sent to a 2 phase separator as illustrated in FIG. 1 Item 3, where the diesel phase is separated via coalesce from the second phase consisting of water, tungstate/phosphoric acid (PTA) and PTC. The water and tungstate are then separated from the PTC via centrifuge thereby regenerating the PTC. The water and tungstate has the water/tungstate ratio reduced by evaporating off excess water (introduced from the breakdown of hydrogen peroxide) and the water tungstate mixture at the desired concentration is recirculated to the feed tank to be reused.

After the oxidation and first separation, the diesel is subjected to a polar extractant, which is then separated from the diesel. The extractant is then centrifuged to remove sulphones, therefore regenerating the polar extractant. The diesel is then sent to a polishing stage for removal of large molecular weight contaminants as a final processing step.

FIG. 2

The present invention will now be further described by way of preferred embodiments as described below and referenced to FIG. 2, which are intended to be illustrative only and not restrictive.

This embodiment is added to the oxidation portion of the process and allows greater flexibility for processing more demanding low electron density sulphur hydrocarbon or high sulphur mass hydrocarbon streams. These embodiments provide plurality on oxidation cycles using a different oxidant in the secondary oxidation cycle. This alleviates a single point oxidant failure by using either of the aforementioned secondary oxidants, those options being:

1) Hydroxyl Radicals as described previously.

2) Chlorine Dioxide in solution as described previously.

3) Hypofluorous Acid stabilized in Acetonitrile as described previously.

4) Liquid Ferrate VI as described previously.

Figure 2:
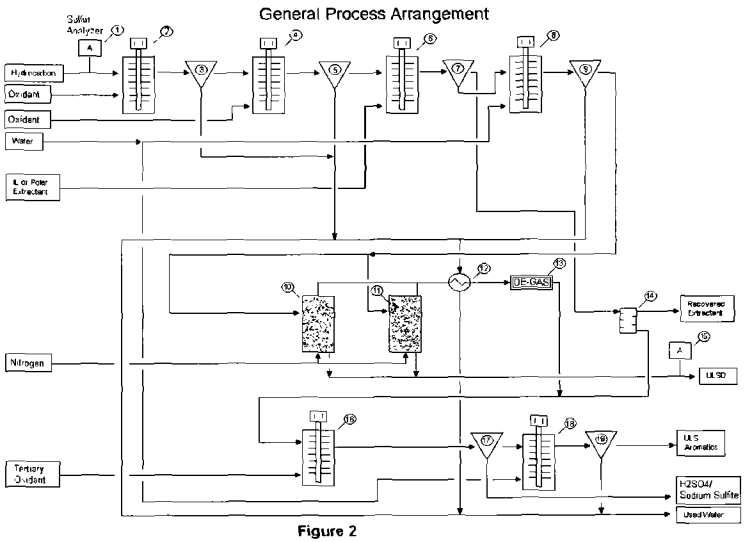
FIG. 2 shows a general scheme for the process disclosed herein according to a preferred embodiment of the first or second aspect using a primary and secondary oxidant.

FIG. 2 shows a general scheme for another embodiment of the process of the disclosed herein. In this embodiment, initial sulphur content of a hydrocarbon feedstock is measured (Sulphur Analyser A) item 1 on FIG. 2. The hydrocarbon feedstock is heated, if required and prior to delivery to the process battery limits to a temperature in the range of about 30° C. (86° F.) to 65° C. (149° F.) and introduced at a pressure in the range of about 140 kPa (20 PSI) to 350 kPa (50 PSI) into the primary oxidation reactor item 2 on FIG. 2. Any of the aforementioned primary oxidant, those being:

N-chloroimide

Hypobromous Acid

Electrolysed Oxidizing water

Catalyzed and co-catalysed Hydrogen Peroxide or

Hypochlorous Acid is introduced at the same time and at a temperature preferably in the range of about 20° C. (68° F.) to 30° C. (86° F.), when N-chloroimide, Electrolysed Oxidizing water or Hypobromous Acid is the selected stage 1 oxidant. The amount of introduced oxidant is proportionally metered in at a rate equivalent to 2 moles to 4 moles of oxidant to 1 mol of sulphur as detected by the on line Total Sulphur Analyzer (A) item 1 on FIG. 2. This oxidant is sufficient to oxidise the sulphur compounds in the hydrocarbon feedstock to sulphoxides and/or sulphones. If N-chloroimide is used the constituent sodium hypochlorite is preferably manufactured on site using brine electrolysis techniques, a concept known to and accepted by those skilled in the art. If the location of the process is such that bulk sodium hypochlorite is available at concentration of from about 6% to 24%, this may enable the use of off-site manufactured sodium hypochlorite. The said oxidizer is introduced to an agitated column or equivalent reactor 2 on FIG. 2, at a controlled pH in the range of about 4 to 6.5. This pH is controlled by the addition of either muriatic acid or citric acid at 10% concentration to the sodium hypochlorite solution and if the pH lowers past a desired set point, the control system will add further sodium hypochlorite until the pH is normalized to the desired set point. The reactor residence time is designed to be in the range of about 5 seconds to 90 seconds, or about 10 seconds to 30 seconds, or about 5 seconds to 20 seconds. The same general approach is used when any of the aforementioned primary oxidant is used, that being the oxidant is introduced at the specific stoichiometric rate and mixed for the appropriate time to enable the sulphur species to be oxidized. The different sulphur species respond to the oxidants where generally the primary oxidant preferentially oxidizes the electron rich sulphur compounds, whilst the electro depleted sulphur species require an oxidant having a higher electronegativity such as those used in the secondary oxidation stage.

After mixing the hydrocarbon and oxidant the resultant oxidation reaction occurs in said reactor 2 on FIG. 2, and the hydrocarbon/sulphone/water solution is introduced to a separator 3 on FIG. 2. This separator which can be either a coalescing or centrifugal or electrostatic type, separates any water from the sulphone laden hydrocarbon. The sulphones are created by the oxidation of sulphur compounds, this being achieved essentially by the action of atomic oxygen bonding to sulphur to form the sulphone. This process is afforded in a two step dynamic reaction, which is described above.

The sulphone laden hydrocarbon is then introduced at a temperature in the range of about 30° C. (86° F.) to 65° C. (149° F.) and at a pressure in the range of about 140 kPa (20 PSI) to 350 kPa (50 PSI) to a second reactor 4 on FIG. 2, where any of the aforementioned secondary oxidants is introduced, those being:

Hydroxyl Radicals as described previously,

Chlorine Dioxide in solution as described previously,

Hypofluorous Acid stabilized in Acetonitrile as described previously,

Liquid Ferrate VI as described previously.

The secondary oxidant is used to oxidize remaining non oxidized sulphur compounds, typically the electron depleted species. If secondary oxidant selected is stabilized chlorine dioxide solution at concentration in the range of about 3000 ppm (0.3%) to 8000 ppm (0.8%) this is introduced at a temperature in the range of about 20° C. (68° F.) to 35° C. (95° F.) and at a pressure in the range of about 140 kPa (20 PSI) to 350 kPa (50 PSI) to oxidize sulphur compounds which were not oxidized with the first stage primary oxidant in reactor 1 on FIG. 2. The amount of any selected secondary oxidant will typically be set at a rate of about 1 mole to 2 mols of oxidizer to 1 mole of sulphur. The reactor residence time is designed to be about 5 seconds to 90 seconds, in some cases 10 seconds to 30 seconds, and in other cases 5 seconds to 20 seconds.

The secondary oxidized hydrocarbon is then introduced to separator 5 on FIG. 2. This separator which can be either a coalescing or centrifugal or electrostatic type, separates any water from the sulphone laden hydrocarbon. This sulphone laden hydrocarbon can be subject to water washing and as this step is optional it is not shown on FIG. 2. In addition to this step not displayed on FIG. 2, an option of additional secondary oxidation stages can be exercised. This plurality of additional oxidation treatments may be desirable, if not necessary, dependent upon the amount and compounds of sulphur present in the feedstock hydrocarbon.

The substantially water free sulphone laden hydrocarbon exiting separator 5 on FIG. 2, is then introduced to reactor 6 on FIG. 2, where the polar extraction solvent is also introduced. The sulphone laden hydrocarbon is introduced at a temperature in the range of about 30° C. (86° F.) to 65° C. (149° F.) and at a pressure in the range of about 140 kPa (20 PSI) to 350 kPa (50 PSI), where the polar extraction solvent is introduced at temperatures in the range of about 30° C. (86° F.) to 65° C. (149° F.) to extract or absorb the polar oxidized sulphur compounds or sulphones. The extraction solvent by volume can range from about 20% to 75% of the volume of hydrocarbon. For economic reasons this amount is to be kept to a minimum and is expected to be in the range of about 30% to 35%. The reactor residence time is designed to be in the range of about 25 seconds to 90 seconds, in some cases 20 seconds to 30 seconds, and in other cases 15 seconds to 20 seconds.

Following the sulphone extraction process accomplished in reactor 6 on FIG. 2, the sulphone stream which is solubilized in the polar extraction solvent, is separated from the substantially sulphur free hydrocarbon via separator 7 on FIG. 2. This separator can be either a coalescing or centrifugal or electrostatic type.

Following the separation of the sulphone rich stream from the substantially sulphur free hydrocarbon, the sulphone rich stream is distilled in the distillation unit 14 on FIG. 2. Distillation, nano filtration or RO techniques may be used to recover the extraction solvent and provide a concentrated sulphone stream. The distillation and separation techniques are well known to those skilled in the art, and distillation characteristics will be determined by the selected extraction solvent's boiling point.

The substantially sulphur free hydrocarbon stream exiting separator 7 on FIG. 2 is then introduced to reactor 8 on FIG. 2. The sulphone extracted hydrocarbon is introduced at a temperature in the range of about 30° C. (86° F.) to 65° C. (149° F.) and at a pressure in the range of about 140 kPa (20 PSI) to 350 kPa (50 PSI), where any residual polar extraction solvent is washed out from the hydrocarbon. Water is introduced to reactor 8 on FIG. 2 at temperatures in the range of about 30° C. (86° F.) to 65° C. (149° F.) and at a pressure in the range of about 140 kPa (20 PSI) to 350 kPa (50 PSI) to polish any extraction solvent remaining in the sulphone extracted hydrocarbon stream exiting from separator 7 on FIG. 2. The wash/polish water by volume can range in the range of about 20% to 75% of the volume of hydrocarbon. The reactor residence time is designed to be in the range of about 25 seconds to 90 seconds, in some cases 20 seconds to 30 seconds, and in other cases 15 seconds to 20 seconds.

Following the water washing and hydrocarbon polishing process accomplished in reactor 8 on FIG. 2, the hydrocarbon phase is introduced to separator 9 on FIG. 2, where the Ultra Low Sulphur Hydrocarbon is separated from the polishing water to exit separator 9 on FIG. 2 as treated and sulphur free hydrocarbon. The polishing water is separated and becomes used water.

The sulphur free hydrocarbon exiting separator 9 on FIG. 2 is then subjected to a polishing stage, which removes any sulfones which may have been left in the water washed hydrocarbon exiting reactor 8 on FIG. 2.

The polishing stage consists of two adsorbent laden columns items 10 and 11 on FIG. 2. One column is in "adsorption" mode whilst the other is in 'desorption" mode. In adsorption mode the sulfur free hydrocarbon is directed to the column designated at that instant as being in adsorption mode, which is charged with media consisting of either of the following adsorbents known to those skilled in the art;

Y-Zeolite

Activated Carbon

MOF (Metal Organic Framework) adsorbents such as but not restricted to CuCl2MIL-47 (Material of Institute Lavoisier) or BASF product line of Basolite® C300 (C18H6Cu3O12), Cu Impegnated Chabazite or Fullers Earth.

The adsorbent material acts as a physiochemical extraction system in which any remaining sulphur compounds, whether oxidized or not oxidized, are adsorbed into the adsorbent media's structure. The preferred adsorption cycle is 24 hours, after which the adsorbent must undergo desorption via the injection of $N_2$ at a temperature sufficient to vaporize and strip the adsorbed sulphur compounds under a vacuum. The temperature is above the boiling point of any retained sulphur compound. This can exceed 250° C. (482° F.) at atmospheric pressure but under vacuum will be substantially lower temperature as will be appreciated by those skilled in the art. The hydrocarbon is redirected to the other identical column which at that time is in adsorption mode whilst the previous adsorption mode column switches to desorption mode. The desorption cycle is designed to be exposed to the $N_2$ stripping or desorption mode for up to 4 hours, more preferably 3 hours, most preferably 2 hours after which said column is in a standby mode awaiting for the cyclic change back to adsorption mode. During the adsorption cycle on both columns 10 and 11, the hydrocarbon stream exiting said columns is a sulphur free hydrocarbon and if said hydrocarbon is a diesel cut, the resultant exit stream will be ULSD (ultra low sulphur diesel).

If the hydrocarbon has not satisfied the sulphur reduction target as measured by the on line Total Sulphur Analyzer A item 14 on FIG. 2 installed at the treated hydrocarbon process exit, the "off specification" hydrocarbon stream will be automatically diverted to the primary oxidation reactor 2 on FIG. 2, for reprocessing Purged or stripped sulfur species and $N_2$ exiting either column 10 or column 11, depending on which column is in desorption mode, is cooled to a temperature nominally 50° C. (122° F.) via conventional heat exchanging in heat exchanger item 12 on FIG. 2. This cooled stream exiting the heat exchanger item 12 is directed to a degasser membrane or coalescer item 13 on FIG. 2, where separated $N_2$ is vented or recycled and sulphur compounds (typically sulphoxides and/or sulphones) are directed to tertiary oxidation.

The sulphone stream which is the residue resulting from the distillation or separation of the extraction solvent from the sulphones in the distillation unit 14 on FIG. 2, is introduced to reactor 16 on FIG. 2. It is introduced at temperatures in the range of about 30° C. (86° F.) to 65° C. (149° F.) and at a pressure in the range of about 140 kPa (20 PSI) to 350 kPa (50 PSI). Introduced to reactor 16 is also a caustic solution at a concentration of 5% to 70%. This is introduced at temperatures in the range of about 40° C. (104° F.) to 80° C. (176° F.) and at a pressure in the range of about 140 kPa (20 PSI) to 350 kPa (50 PSI). This stage of the process is very important and is used to separate the sulphur free aromatic hydrocarbon component of the sulphone from the sulphone component. The sulphone component is converted to sodium sulfite solution per the following chemistry:

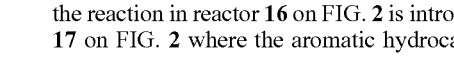

$$R—SO_2+2NaOH \rightarrow Na_2SO_3+R+H_2O$$

The sulphur free aromatic hydrocarbons resulting from the reaction in reactor 16 on FIG. 2 is introduced to separator 17 on FIG. 2 where the aromatic hydrocarbon components are separated from the sodium sulfite solution. This separator can be either a coalescing or centrifugal or electrostatic type.

The sulphur free aromatic hydrocarbon stream exiting separator 17 on FIG. 2, is introduced to reactor 18 on FIG. 2 at temperatures in the range of about 40° C. (104° F.) to 80° C. (176° F.) and at a pressure in the range of about 140 kPa (20 PSI) to 350 kPa (50 PSI). Water is introduced simultaneously into reactor 18 at temperature in the range of about 40° C. (104° F.) to 80° C. (176° F.) and at a pressure in the range of about 140 kPa (20 PSI) to 350 kPa (50 PSI). The residence time in this reactor is in the range of about 20 seconds to 60 seconds, preferably 15 seconds to 30 seconds. This stage is added to water wash the aromatics stream, thereby polishing any residual caustic out of the aromatics hydrocarbon stream. The raffinate from separator 17 on figure is sodium sulfite.

The substantially water free aromatics stream exiting reactor 18 is then introduced to separator 19 on FIG. 2, where residual water is removed thereby producing ultra low sulphur aromatics and a low concentrate sodium sulfite raffinate. The water washed aromatic hydrocarbon has uses in multiple industrial applications, known to those skilled in the art. Most importantly, there is very low loss of valuable aromatics hydrocarbons and the sulphur is not in the form of high availability elemental sulphur, but in a sodium sulfite solution, which could be dehydrated if required.

If particular locations do not have onerous limitations on either or both Total Aromatics or PAH, the sulphur free aromatics can be blended back into the Ultra Low Sulphur Hydrocarbon stream exiting from adsorption columns 10 and 11 on FIG. 2.

EXAMPLES

Sulphur Analysis

Natural Gas Condensates (NGC), high sulphur diesel hydrocarbons and jet fuel streams were reacted with an oxidant and their sulphur content was examined before and after the oxidation process.

Results are provided in Tables 1 to 10.

Example 1

Natural Gas Condensates (NGC)

a) Molecular Oxygen as Oxidant

The sulfur species in the Natural Gas Condensate (NGC) source were electron dense and thus were readily oxidized. Accordingly, no active catalyst/co-catalyst was required. The oxidant used was molecular oxygen. The mechanism of oxidation emulates that of oxidation using either primary or secondary oxidants or combination thereof: this being a transfer of electrons from sulphur being taken up by oxygen thereby producing sulphones. The actual SGS (Society Generale De Surveillance) results recorded using NGC were obtained using molecular oxygen as the oxidant followed by IL/water extraction and hydrocarbon water wash/polishing techniques as described below. The source of the oxygen was bottled oxygen of purity of 99%. The IL used is triisobutyl (methyl) phosphonium tosylate.

A 5 gallon sample of the NGC was circulated from a 7 gallon heating reactor through an eductor to a series of 3 in line static mixers. These mixers although not as effective as the counter current agitated column type reactor, served to mix the gas phase (oxygen) with the liquid NGC phase. It was not expected that the mixing kinetics would emulate that of the reactor; hence residence time was approximately 65 minutes. The NGC was returned to the reactor via the static mixers.

The NGC was circulated under pressure at about 150 psi and was slowly heated over a 20 minute period until the NGC reached a temperature of about 65° C. (149° F.). When this temperature was reached, an oxygen feed of about 95% purity was fed to the eductor. The feed was metered such that an amount of about 3 times the stoichiometric requirement was injected over the oxidation duration. The oxygen was vented at a rate which was approximately 50% of the feed flow rate. This venting also allowed for sufficient differential pressure across the eductor, thus maintaining sufficient velocity through the static mixers to promote optimum two phase mixing.

At the completion of the oxidation phase the NGC was allowed to cool to about 40° C. (104° F.). Approximately 100 mls of IL was warmed to about 40° C. (104° F.) and added to a 250 ml sample of NGC. The contents were mixed thoroughly with a stirrer for approximately 1 minute and allowed to settle under gravity. During this period a small amount of NGC was vaporized but the IL had been mixed thoroughly and it was assumed that the oxidized Sulphur compounds would be absorbed into the IL.

A sample of the NGC was removed from the two phase solution and this was then added to a separation container. An equal amount of water was added to the NGC in the container. The water was at about 35° C. (95° F.) and this mixture of NGC and water was thoroughly stirred for a minute. The mixture was allowed to separate under gravity for approximately 2 minutes, after which the NGC was extracted into a new container. An equivalent amount of water was added to the NGC and was mixed as per the first water wash. The treated NGC was bottled and sent for a total Sulphur measurement and Sulphur compounds identification.

It was then assumed that (i) Sulphur in the NGC feedstock would have been converted to sulfoxide and/or sulphone and (ii) that these oxidized compounds, upon contact with IL, migrate preferentially into the IL phase of the biphasic system and (iii) any residual IL would have been separated from the NGC, such that the sulphur compounds would be removed from the NGC.

The IL used in the extraction process was loaded with some organic matter assumed to be aromatic sulphur oxidation products, as the IL had darkened and after the addition of heated water at 40° C. (104° F.) and a vigorous stirring, a sulphur containing organic layer separated after approximately 30 seconds, from completion of stirring.

b) Catalysed $H_2O_2$ as Oxidant

Replacing the oxidant used in a) above with catalysed hydrogen peroxide achieved the same result. Hydrogen peroxide when catalyzed with a rate controlled catalyst such as the combination of sodium tungstate dihydrate and phosphoric acid (phosphotungstic acid), breaks down to singlet oxygen/OH radical. As only electron rich sulphur species were present in this very low boiling (36° C.) point feedstock and accordingly, only a primary oxidant was used. The oxidation was achieved using decomposing hydrogen peroxide and the accompanying PTC was not required due to the aforementioned electron dense sulphur species. It is also supposed that the very light condensate was readily oxidized with the oxidant and catalyst without the PTC, because at most times during the oxidation process it was possible that the hydrocarbon was in the gas phase, therefore phase transfer became a non dominant factor compared to its essential requirement when oxidizing heavier hydrocarbon streams which at the normal oxidation process temperature is always in the liquid phase. This, as well as the sulphur species being easily oxidized, appears to be the reason that the aforementioned oxidant alone was sufficient to oxidize the sulphur compounds present.

The same test protocol and equipment as was used in a) was used.

A 5 gallon sample of the NGC was circulated from a 7 gallon heating reactor through an eductor to a series of 3 in line static mixers. These mixers although not as effective as the counter current agitated column type reactor, served to mix the aqueous oxidant, which was Hydrogen Peroxide at 30% concentration in conjunction with the decomposition moderator catalyst Sodium Tungstate Dihydrate and reagent grade Phosphoric Acid, with the liquid NGC phase. It was not expected that the mixing kinetics would emulate that of the reactor; hence residence time was approximately 80 minutes. The NGC was returned to the reactor via the static mixers.

The NGC was circulated under pressure at about 100 psi and was slowly heated over a 20 minute period until the NGC reached a temperature of about 65° C. (149° F.). When this temperature was reached, the aqueous Hydrogen Peroxide was fed through a needle restrictor valve into the venturi eductor. The feed was metered such that an amount of about 2.5 times the stoichiometric requirement was injected over the initial oxidation period of 2 minutes and then again at the 20 minute elapsed time for a further 2 minute period. The recipe for the experiment was as follows:

Hydrogen Peroxide @ 30% concentration=120 mls

Sodium Tungstate Dihydrate in solution (water miscible @ approximately 1:1.1)=4.5 mls Phosphoric Acid reagent grade=0.9 mls At the completion of the oxidation phase the NGC was allowed to cool to about 40° C. (104° F.). Approximately 100 mls of IL was warmed to about 40° C. (104° F.) and added to a 250 ml sample of NGC. The contents were mixed thoroughly with a stirrer for approximately 1 minute and allowed to settle under gravity. During this period a small amount of NGC was vaporized but the IL had been mixed thoroughly and it was assumed that the oxidized Sulphur compounds would be absorbed into the IL as was the water resulting from the decomposition of Hydrogen Peroxide.

A sample of the NGC was removed from the two phase solution and this was then added to a separation container. An equal amount of water was added to the NGC in the container. The water was at about 35° C. (95° F.) and this mixture of NGC and water was thoroughly stirred for a minute. The mixture was allowed to separate under gravity for approximately 2 minutes, after which the NGC was extracted into a new container. An equivalent amount of water was added to the NGC and was mixed as per the first water wash.

It was then assumed that (i) Sulphur in the NGC feedstock would have been converted to sulfoxide and/or sulphone and (ii) that these oxidized compounds, upon contact with IL, migrate preferentially into the IL phase of the biphasic system and (iii) any residual IL would have been separated from the NGC, such that the sulphur compounds would be removed from the NGC.

The IL used in the extraction process was loaded with some organic matter assumed to be aromatic sulphur oxidation products, as the IL had darkened and after the addition of heated water at 40° C. (104° F.) and a vigorous stirring, a sulphur containing organic layer separated after approximately 30 seconds, from completion of stirring. The treated NGC was subsequently centrifuged after which it was then tested on a Spectro 2000 XRF Total Sulfur Analyzer. This analysis detected 9.8 ppm of Sulphur. This sample was not independently verified by SGS laboratories, hence no verification data is supplied. The test was conducted to compare the efficacy differential between catalysed Hydrogen Peroxide and Molecular Oxygen. It was supposed at the time of testing that due to the nature of the sulphur compounds and the expected gas phase NGC, both oxidant combinations would work and that PTC would not be required.

The test results for Example 1 are provided in Tables 1 to 4. Table 1 provides a component breakdown and table 2 provides a feedstock analysis (speciation and total sulphur) whilst tables 3 and 4 display results of the treated NGC.

This Example demonstrates that the sulphur in NGC is relatively easily oxidized because of what the inventor believes are the lower molecular weight sulphur compounds having more electron dense species. It is known that the higher boiling point sulphur compounds migrate to the heavier MW streams such as diesel and these species are more resistant to oxidation. Because of the relative ease of sulphur oxidation in NGC, PTC was not required to affect a quantitative oxidation of sulphur. It is believed however, that PTC would have assisted but is not absolutely necessary in the case of sulphur oxidation in the lighter fraction hydrocarbon. The process disclosed herein intends to cover the removal of sulphur from more complex sulphur containing hydrocarbon materials.

Example 2

Transmix Diesel Hydrocarbon (Catalysed and Co-Catalysed $H_2O_2$)

A 3 gallon sample of transmix hydrocarbon was circulated through a controlled cavitation mixing reactor which induced heating internally in the reactor. The feedstock at ambient temperature was circulated for approximately 3 minutes which effected a temperature rise from ambient 20° C. (68° F.) to 70° C. (158° F.). When the hydrocarbon temperature reached 65-70° C., catalysed and co-catalysed hydrogen peroxide (hydrogen peroxide and phosphotungstic acid and Ultra C PTC) was entered via an eductor through which the hydrocarbon flowed at a pressure of about 20 psi. After the oxidant (catalysed and co-catalysed hydrogen peroxide) was applied to the hydrocarbon via a venture and needle regulating valve, the resultant hydrocarbon/oxidant was fed to an in-line static mixer directly into the diesel entry of the inlet of the in-line mixer reactor.

The mixed hydrocarbon was circulated via a holding tank being reacted with the oxidant at a rate of about twice stoichiometric based on the sulphur content (molar) in the hydrocarbon feedstock.

The hydrocarbon was circulated through the system for a time period of 60 minutes, which equated to 5 minutes accumulated residence time in a typically used counter current reactor. Samples were taken at timed intervals, however the sample taken at the end of the aforementioned 60 minute period, was subjected to the IL extraction procedure and water wash/polishing procedure as described in the procedure for desulphurizing NGC.

After the IL extraction and water wash/polish procedure, a sample was taken and analysed using a Spectro XRF (X Ray Fluoresence) laboratory analyser. A separate comparative sample was sent to SGS (Society Generale De Surveillance) for a total Sulphur measurement and Sulphur compounds identification. The internal and SGS laboratory measurements compared favourably, with the internal (Spectro XRF analysis) measuring some 5 ppm higher than the SGS data.

The test results of this Transmix Hydrocarbon feedstock and desulphurized Transmix Hydrocarbon are provided in Tables 5 and 6.

Example 3

Refinery Diesel Hydrocarbon

A Refinery hydrocarbon sample of 3 gallons was treated. The procedure and methodology and equipment used were identical to that described in the aforementioned Transmix Hydrocarbon description in Example 2.

The test results of this Refinery Hydrocarbon feedstock and desulphurized Refinery Hydrocarbon are provided in Tables 7 and 8.

Example 4

Jet Fuel

A 3 gallon Jet fuel sample was treated. The procedure and methodology and equipment used were identical to that described in the aforementioned Transmix Hydrocarbon description in Example 2. The test results of this Jet Fuel feedstock and desulphurized Jet Fuel are provided in Tables 9 and 10.

TABLE 1

NGC feedstock - hydrocarbon analysis

| | Total(mass %): | Total(vol %): |
|---|---|---|
| Group Type: | | |
| Paraffins: | 36.910 | 38.348 |
| I-paraffins: | 44.299 | 45.624 |
| Olefins: | 0.093 | 0.086 |
| Naphthenes: | 13.222 | 11.489 |
| Aromatics: | 2.699 | 2.044 |
| Total C14+: | 2.757 | 2.391 |
| Total Unknowns: | 0.020 | 0.018 |
| Grand Total: | 100.000 | 100.000 |
| Oxygenates: | | |
| Total: | 0.000 (mass %) | 0.000 (vol %) |
| Total Oxygen Content: | 0.000 (mass %) | |
| Multisubstituted Aromatics: | 0.211 (mass %) | 0.160 (vol %) |

Average Molecular Weight: 78.627
Relative Density: 0.643
Vapor Pressure, calc. RVP (EPA method): 10.43 (psi @ 100° F.)
Octane Number (calculated): 73.95

| Boiling Point (est.): | IBP: | T10: | T50: | T90: | FBP |
|---|---|---|---|---|---|
| | 31.10° F. | 82.11° F. | 96.91° F. | 213.67° F. | 488.6 |

TABLE 1-continued

NGC feedstock - hydrocarbon analysis

Percent Carbon: 84.060
Percent Hydrogen: 15.940
Bromine Number (calc.): 0.161

TABLE 2

NGC feedstock - sulphur analysis

| Sulfur Compounds | Concentration (ppm wt) as compound | Concentration (ppm wt) as sulfur |
|---|---|---|
| Hydrogen Sulfide | <0.1 | <0.1 |
| Carbonyl Sulfide | 3.0 | 1.6 |
| Methyl Mercaptan (Methanethiol) | 0.2 | 0.1 |
| Ethyl Mercaptan (Ethanethiol) | 7.1 | 3.7 |
| Isopropyl Mercaptan (2-Propanethiol) | 0.4 | 0.2 |
| n-Propyl Mercaptan (1-Propanethiol) | 3.1 | 1.3 |
| tert-Butyl Mercaptan (2-Methyl-2-Propanethiol) | 3.0 | 1.1 |
| sec-Butyl Mercaptan (1-Methyl-1-Propanethiol) | <0.1 | <0.1 |
| Isobutyl Mercaptan (2-Methyl-1-Propanethiol) | 10.6 | 3.8 |
| n-Butyl Mercaptan (1-Butanethiol) | 15.3 | 5.4 |
| Thiophenol(VinylMercaptan) | 0.7 | 0.2 |
| Methyl Sulfide | 66.2 | 34.2 |
| Carbon Disulfide | 7.9 | 6.7 |
| Ethylmethyl Sulfide | 78.6 | 33.1 |
| Ethyl Sulfide | <0.1 | <0.1 |
| Dimethyl Disulfide | 22.3 | 15.2 |
| Diethyl Disulfide | <0.1 | <0.1 |
| n-Butyl Sulfide | <0.1 | <0.1 |
| n-Dibutyl DiSulfide | <0.1 | <0.1 |
| Phenyl Sulfide | <0.1 | <0.1 |
| Thiophene | <0.1 | <0.1 |
| 2-Methyl-Thiophene | <0.1 | <0.1 |
| 3-Methyl-Thiophene | 1.8 | 0.6 |
| TetrahydroThiophene | 1.3 | 0.5 |
| 2-Ethyl-Thiophene | 0.3 | <0.1 |
| Total DimethylThiophene | 356.4 | 101.9 |
| 3-Ethyl-Thiophene | 1.6 | 0.5 |
| Total TrimethylThiophene | 554.7 | 140.9 |
| Total TetrarmethylThiophene | 147.6 | 33.8 |
| Benzo[b]Thiophene (Thianaphthene) | 1.0 | 0.2 |
| Methylbenzothiophen | 89.6 | 19.4 |
| Dimethylbenzothiophene | 7.8 | 1.5 |
| Phenylthiophene | 2.0 | 0.4 |
| Trimethylbenzothiophene | 1.1 | 0.2 |
| Tetramethylbenzothiophene | <0.1 | <0.1 |
| DIBENZOTHIOPHENE | <0.1 | <0.1 |
| Methyldibenzothiophene | 0.5 | <0.1 |
| Ethyldibenzothiophene | <0.1 | <0.1 |
| 4,6 Dimethyldibenzothiophene | 0.1 | <0.1 |
| Dimethyldibenzothiophene | <0.1 | <0.1 |
| Trimethyldibenzothiophene | <0.1 | <0.1 |
| Unidentified Sulfur Compounds | 107.1 | 25.6 |

Total Sulfur 432.0 PPM WT

TABLE 4

NGC - Desulphurized - sulphur analysis - sample 2

| Sulfur Compounds | Concentration (ppm wt) as compound | Concentration (ppm wt) as sulfur |
|---|---|---|
| Hydrogen Sulfide | <0.1 | <0.1 |
| Carbonyl Sulfide | 0.2 | 0.1 |
| Methyl Mercaptan (Methanethiol) | <0.1 | <0.1 |
| Ethyl Mercaptan (Ethanethiol) | <0.1 | <0.1 |
| Isopropyl Mercaptan (2-Propanethiol) | <0.1 | <0.1 |
| n-Propyl Mercaptan (1-Propanethiol) | <0.1 | <0.1 |
| tert-Butyl Mercaptan (2-Methyl-2-Propanethiol) | <0.1 | <0.1 |
| sec-Butyl Mercaptan (1-Methyl-1-Propanethiol) | <0.1 | <0.1 |
| Isobutyl Mercaptan (2-Methyl-1-Propanethiol) | <0.1 | <0.1 |

TABLE 4-continued

NGC - Desulphurized - sulphur analysis - sample 2

| Sulfur Compounds | Concentration (ppm wt) as compound | as sulfur |
|---|---|---|
| n-Butyl Mercaptan (1-Butanethiol) | <0.1 | <0.1 |
| Thiophenol(VinylMercaptan) | <0.1 | <0.1 |
| Methyl Sulfide | <0.1 | <0.1 |
| Carbon Disulfide | 2.8 | 2.3 |
| Ethylmethyl Sulfide | <0.1 | <0.1 |
| Ethyl Sulfide | <0.1 | <0.1 |
| Sulfides | <0.1 | <0.1 |
| Methyl Disulfide | <0.1 | <0.1 |
| Ethyl Disulfide | <0.1 | <0.1 |
| sec-Butyl Sulfide | <0.1 | <0.1 |
| n-Butyl Sulfide | <0.1 | <0.1 |
| n-Butyl DiSulfide | <0.1 | <0.1 |
| Phenyl Sulfide | 4.0 | 0.7 |
| Thiophene | <0.1 | <0.1 |
| 2-Methyl-Thiophene | <0.1 | <0.1 |
| 3-Methyl-Thiophene | <0.1 | <0.1 |
| TetrahydroThiophene | <0.1 | <0.1 |
| 2-Ethyl-Thiophene | <0.1 | <0.1 |
| Total DimethylThiophene | <0.1 | <0.1 |
| 3-Ethyl-Thiophene | <0.1 | <0.1 |
| Total TrimethylThiophene | <0.1 | <0.1 |
| Bromothiophene | <0.1 | <0.1 |
| Total TetrarmethylThiophene | <0.1 | <0.1 |
| Benzo[b]Thiophene (Thianaphthene) | <0.1 | <0.1 |
| Methylbenzothiophen | <0.1 | <0.1 |
| Dimethylbenzothiophene | <0.1 | <0.1 |
| Phenylthiophene | <0.1 | <0.1 |
| Trimethylbenzothiophene | <0.1 | <0.1 |
| Tetramethylbenzothiophene | <0.1 | <0.1 |
| DIBENZOTHIOPHENE | <0.1 | <0.1 |
| Methyldibenzothiophene | <0.1 | <0.1 |
| Ethyldibenzothiophene | <0.1 | <0.1 |
| 4,6 Dimethyldibenzothiophene | <0.1 | <0.1 |
| Other Dimethyldibenzothiophene | <0.1 | <0.1 |
| Unidentified Sulfur Compounds | 7.0 | 1.7 |

Total Sulfur 4.8 PPM WT

TABLE 5

Transmix Diesel Hydrocarbon Feedstock - sulphur analysis

| Sulfur Compounds | Concentration (ppm wt) as compound | as sulfur |
|---|---|---|
| Hydrogen Sulfide | <0.1 | <0.1 |
| Carbonyl Sulfide | <0.1 | <0.1 |
| Methyl Mercaptan (Methanethiol) | <0.1 | <0.1 |
| Ethyl Mercaptan (Ethanethiol) | <0.1 | <0.1 |
| Isopropyl Mercaptan (2-Propanethiol) | <0.1 | <0.1 |
| n-Propyl Mercaptan (1-Propanethiol) | <0.1 | <0.1 |
| tert-Butyl Mercaptan (2-Methyl-2-Propanethiol) | <0.1 | <0.1 |
| sec-Butyl Mercaptan (1-Methyl-1-Propanethiol) | <0.1 | <0.1 |
| Isobutyl Mercaptan (2-Methyl-1-Propanethiol) | <0.1 | <0.1 |
| n-Butyl Mercaptan (1-Butanethiol) | <0.1 | <0.1 |
| Thiophenol(VinylMercaptan) | 0.9 | 0.3 |
| Methyl Sulfide | <0.1 | <0.1 |
| Carbon Disulfide | <0.1 | <0.1 |
| Ethylmethyl Sulfide | <0.1 | <0.1 |
| Ethyl Sulfide | <0.1 | <0.1 |
| Dimethyl Disulfide | <0.1 | <0.1 |
| Diethyl Disulfide | 0.4 | 0.2 |
| n-Butyl Sulfide | <0.1 | <0.1 |
| n-Dibutyl DiSulfide | <0.1 | <0.1 |
| Phenyl Sulfide | 35.6 | 6.1 |
| Thiophene | <0.1 | <0.1 |
| 2-Methyl-Thiophene | <0.1 | <0.1 |
| 3-Methyl-Thiophene | <0.1 | <0.1 |
| TetrahydroThiophene | <0.1 | <0.1 |
| 2-Ethyl-Thiophene | <0.1 | <0.1 |
| Total DimethylThiophene | 5.4 | 1.6 |

TABLE 5-continued

Transmix Diesel Hydrocarbon Feedstock - sulphur analysis

| Sulfur Compounds | Concentration (ppm wt) as compound | as sulfur |
|---|---|---|
| 3-Ethyl-Thiophene | <0.1 | <0.1 |
| Total TrimethylThiophene | 46.9 | 11.9 |
| Total TetrarmethylThiophene | 167.4 | 38.3 |
| Benzo[b]Thiophene (Thianaphthene) | 22.4 | 5.4 |
| Methylbenzothiophen | 309.7 | 67.1 |
| Dimethylbenzothiophene | 580.7 | 114.9 |
| Phenylthiophene | 72.1 | 14.4 |
| Trimethylbenzothiophene | 417.2 | 76.0 |
| Tetramethylbenzothiophene | 8.0 | 1.3 |
| DIBENZOTHIOPHENE | 7.9 | 1.4 |
| Methyldibenzothiophene | 8.1 | 1.3 |
| Ethyldibenzothiophene | <0.1 | <0.1 |
| 4,6 Dimethyldibenzothiophene | <0.1 | <0.1 |
| Other Dimethyldibenzothiophene | 7.2 | 1.1 |
| Trimethyldibenzothiophene | <0.1 | <0.1 |
| Unidentified Sulfur Compounds | 274.9 | 65.7 |

Total Sulfur 407.0 PPM WT

TABLE 6

Transmix Diesel Hydrocarbon - desulphurized - sulphur analysis

| Sulfur Compounds | Concentration (ppm wt) as compound | as sulfur |
|---|---|---|
| Hydrogen Sulfide | <0.1 | <0.1 |
| Carbonyl Sulfide | <0.1 | <0.1 |
| Methyl Mercaptan (Methanethiol) | 0.8 | 0.5 |
| Ethyl Mercaptan (Ethanethiol) | <0.1 | <0.1 |
| Isopropyl Mercaptan (2-Propanethiol) | 0.4 | 0.2 |
| n-Propyl Mercaptan (1-Propanethiol) | <0.1 | <0.1 |
| tert-Butyl Mercaptan (2-Methyl-2-Propanethiol) | 2.5 | 0.9 |
| sec-Butyl Mercaptan (1-Methyl-1-Propanethiol) | <0.1 | <0.1 |
| Isobutyl Mercaptan (2-Methyl-1-Propanethiol) | <0.1 | <0.1 |
| n-Butyl Mercaptan (1-Butanethiol) | <0.1 | <0.1 |
| Thiophenol(VinylMercaptan) | <0.1 | <0.1 |
| Methyl Sulfide | <0.1 | <0.1 |
| Carbon Disulfide | <0.1 | <0.1 |
| Ethylmethyl Sulfide | <0.1 | <0.1 |
| Ethyl Sulfide | <0.1 | <0.1 |
| Dimethyl Disulfide | <0.1 | <0.1 |
| Diethyl Disulfide | <0.1 | <0.1 |
| n-Butyl Sulfide | <0.1 | <0.1 |
| n-Dibutyl DiSulfide | <0.1 | <0.1 |
| Phenyl Sulfide | 0.6 | 0.1 |
| Thiophene | 0.5 | 0.2 |
| 2-Methyl-Thiophene | <0.1 | <0.1 |
| 3-Methyl-Thiophene | <0.1 | <0.1 |
| TetrahydroThiophene | 0.5 | 0.2 |
| 2-Ethyl-Thiophene | <0.1 | <0.1 |
| Total DimethylThiophene | <0.1 | <0.1 |
| 3-Ethyl-Thiophene | <0.1 | <0.1 |
| Total TrimethylThiophene | <0.1 | <0.1 |
| Total TetrarmethylThiophene | 0.6 | 0.1 |
| Benzo[b]Thiophene (Thianaphthene) | <0.1 | <0.1 |
| Methylbenzothiophen | 2.9 | 0.6 |
| Dimethylbenzothiophene | 2.6 | 0.5 |
| Phenylthiophene | <0.1 | <0.1 |
| Trimethylbenzothiophene | <0.1 | <0.1 |
| Tetramethylbenzothiophene | <0.1 | <0.1 |
| DIBENZOTHIOPHENE | <0.1 | <0.1 |
| Methyldibenzothiophene | 5.3 | 0.9 |
| Ethyldibenzothiophene | 4.4 | 0.7 |
| 4,6 Dimethyldibenzothiophene | <0.1 | <0.1 |
| Dimethyldibenzothiophene | <0.1 | <0.1 |
| Trimethyldibenzothiophene | 20.6 | 2.9 |
| Unidentified Sulfur Compounds | 5.7 | 1.4 |

Total Sulfur 9.2 PPM WT

TABLE 7

Refinery Diesel Hydrocarbon Feedstock - sulphur analysis

| Sulfur Compounds | Concentration (ppm wt) as compound | as sulfur |
|---|---|---|
| Hydrogen Sulfide | <0.1 | <0.1 |
| Carbonyl Sulfide | 7.2 | 3.9 |
| Methyl Mercaptan (Methanethiol) | <0.1 | <0.1 |
| Ethyl Mercaptan (Ethanethiol) | <0.1 | <0.1 |
| Isopropyl Mercaptan (2-Propanethiol) | <0.1 | <0.1 |
| n-Propyl Mercaptan (1-Propanethiol) | <0.1 | <0.1 |
| tert-Butyl Mercaptan (2-Methyl-2-Propanethiol) | <0.1 | <0.1 |
| sec-Butyl Mercaptan (1-Methyl-1-Propanethiol) | <0.1 | <0.1 |
| Isobutyl Mercaptan (2-Methyl-1-Propanethiol) | <0.1 | <0.1 |
| n-Butyl Mercaptan (1-Butanethiol) | <0.1 | <0.1 |
| Thiophenol(VinylMercaptan) | 9.7 | 2.8 |
| Methyl Sulfide | <0.1 | <0.1 |
| Carbon Disulfide | 3.0 | 2.5 |
| Ethylmethyl Sulfide | <0.1 | <0.1 |
| Ethyl Sulfide | <0.1 | <0.1 |
| Dimethyl Disulfide | 48.8 | 33.2 |
| Diethyl Disulfide | <0.1 | <0.1 |
| n-Butyl Sulfide | <0.1 | <0.1 |
| n-Dibutyl DiSulfide | <0.1 | <0.1 |
| Phenyl Sulfide | 363.3 | 62.5 |
| Thiophene | 3.9 | 1.5 |
| 2-Methyl-Thiophene | 4.6 | 1.5 |
| 3-Methyl-Thiophene | 3.8 | 1.3 |
| TetrahydroThiophene | <0.1 | <0.1 |
| 2-Ethyl-Thiophene | 1.6 | 0.5 |
| Total DimethylThiophene | 12.6 | 3.6 |
| 3-Ethyl-Thiophene | 4.4 | 1.3 |
| Total TrimethylThiophene | 63.0 | 16.0 |
| Total TetrarmethylThiophene | 108.9 | 24.9 |
| Benzo[b]Thiophene (Thianaphthene) | 826.7 | 197.6 |
| Methylbenzothiophen | 3210.7 | 695.7 |
| Dimethylbenzothiophene | <0.1 | <0.1 |
| Phenylthiophene | 1810.9 | 362.7 |
| Trimethylbenzothiophene | 3973.8 | 724.1 |
| Tetramethylbenzothiophene | 892.5 | 150.6 |
| DIBENZOTHIOPHENE | 1199.5 | 208.9 |
| Methyldibenzothiophene | 1759.1 | 284.8 |
| Ethyldibenzothiophene | 385.1 | 58.2 |
| 4,6 Dimethyldibenzothiophene | 397.2 | 60.1 |
| Dimethyldibenzothiophene | 1684.4 | 254.7 |
| Trimethyldibenzothiophene | 443.6 | 62.9 |
| Unidentified Sulfur Compounds | 3264.6 | 780.1 |

Total Sulfur 3996.0 PPM WT

TABLE 8

Refinery Diesel Hydrocarbon - desulphurized - sulphur analysis

| Sulfur Compounds | Concentration (ppm wt) as compound | as sulfur |
|---|---|---|
| Hydrogen Sulfide | <0.1 | <0.1 |
| Carbonyl Sulfide | 1.3 | 0.7 |
| Methyl Mercaptan (Methanethiol) | <0.1 | <0.1 |
| Ethyl Mercaptan (Ethanethiol) | <0.1 | <0.1 |
| Isopropyl Mercaptan (2-Propanethiol) | <0.1 | <0.1 |
| n-Propyl Mercaptan (1-Propanethiol) | <0.1 | <0.1 |
| tert-Butyl Mercaptan (2-Methyl-2-Propanethiol) | <0.1 | <0.1 |
| sec-Butyl Mercaptan (1-Methyl-1-Propanethiol) | <0.1 | <0.1 |
| Isobutyl Mercaptan (2-Methyl-1-Propanethiol) | <0.1 | <0.1 |
| n-Butyl Mercaptan (1-Butanethiol) | <0.1 | <0.1 |
| Thiophenol(VinylMercaptan) | <0.1 | <0.1 |
| Methyl Sulfide | <0.1 | <0.1 |
| Carbon Disulfide | <0.1 | <0.1 |
| Ethylmethyl Sulfide | 0.2 | <0.1 |
| Ethyl Sulfide | <0.1 | <0.1 |
| Methyl Disulfide | <0.1 | <0.1 |
| Ethyl Disulfide | <0.1 | <0.1 |
| sec-Butyl Sulfide | <0.1 | <0.1 |
| n-Butyl Sulfide | <0.1 | <0.1 |

TABLE 8-continued

Refinery Diesel Hydrocarbon - desulphurized - sulphur analysis

| Sulfur Compounds | Concentration (ppm wt) as compound | as sulfur |
|---|---|---|
| n-Butyl DiSulfide | <0.1 | <0.1 |
| Phenyl Sulfide | 0.9 | 0.2 |
| Thiophene | <0.1 | <0.1 |
| 2-Methyl-Thiophene | <0.1 | <0.1 |
| 3-Methyl-Thiophene | <0.1 | <0.1 |
| 2-Ethyl-Thiophene | <0.1 | <0.1 |
| Benzo[b]Thiophene (Thianaphthene) | 0.3 | <0.1 |
| Methylbenzothiophen | 7.2 | 1.6 |
| Dimethylbenzothiophene | <0.1 | <0.1 |
| Phenylthiophene | <0.1 | <0.1 |
| Trimethylbenzothiophene | <0.1 | <0.1 |
| Tetramethylbenzothiophene | <0.1 | <0.1 |
| DIBENZOTHIOPHENE | <0.1 | <0.1 |
| Methyldibenzothiophene | 7.2 | 1.2 |
| Ethyldibenzothiophene | 33.5 | 5.1 |
| Dimethyldibenzothiophene | 5.7 | 0.9 |
| Trimethyldibenzothiophene | <0.1 | <0.1 |
| Unidentified Sulfur Compounds | 2.0 | 0.5 |

Total Sulfur 10.0 PPM WT

TABLE 9

Jet Fuel Feedstock - sulphur analysis

| Sulfur Compounds | Concentration (ppm wt) as compound | as sulfur |
|---|---|---|
| Hydrogen Sulfide | <0.1 | <0.1 |
| Carbonyl Sulfide | <0.1 | <0.1 |
| Methyl Mercaptan (Methanethiol) | <0.1 | <0.1 |
| Ethyl Mercaptan (Ethanethiol) | <0.1 | <0.1 |
| Isopropyl Mercaptan (2-Propanethiol) | <0.1 | <0.1 |
| n-Propyl Mercaptan (1-Propanethiol) | <0.1 | <0.1 |
| tert-Butyl Mercaptan (2-Methyl-2-Propanethiol) | <0.1 | <0.1 |
| sec-Butyl Mercaptan (1-Methyl-1-Propanethiol) | <0.1 | <0.1 |
| Isobutyl Mercaptan (2-Methyl-1-Propanethiol) | <0.1 | <0.1 |
| n-Butyl Mercaptan (1-Butanethiol) | <0.1 | <0.1 |
| Thiophenol(VinylMercaptan) | 3.3 | 1.0 |
| Methyl Sulfide | <0.1 | <0.1 |
| Carbon Disulfide | <0.1 | <0.1 |
| Ethylmethyl Sulfide | <0.1 | <0.1 |
| Ethyl Sulfide | <0.1 | <0.1 |
| Sulfides | <0.1 | <0.1 |
| Methyl Disulfide | <0.1 | <0.1 |
| Ethyl Disulfide | <0.1 | <0.1 |
| sec-Butyl Sulfide | <0.1 | <0.1 |
| n-Butyl Sulfide | <0.1 | <0.1 |
| n-Butyl DiSulfide | 39.2 | 14.1 |
| Phenyl Sulfide | 154.6 | 26.6 |
| Thiophene | <0.1 | <0.1 |
| 2-Methyl-Thiophene | 0.4 | 0.1 |
| 3-Methyl-Thiophene | 0.3 | 0.1 |
| TetrahydroThiophene | 0.2 | <0.1 |
| 2-Ethyl-Thiophene | 2.2 | 0.6 |
| Total DimethylThiophene | 13.7 | 3.9 |
| 3-Ethyl-Thiophene | <0.1 | <0.1 |
| Total TrimethylThiophene | 262.4 | 66.7 |
| Bromothiophene | <0.1 | <0.1 |
| Total TetrarmethylThiophene | 603.1 | 137.9 |
| Benzo[b]Thiophene (Thianaphthene) | 66.7 | 15.9 |
| Methylbenzothiophen | 1431.8 | 310.3 |
| Dimethylbenzothiophene | 1882.1 | 372.3 |
| Phenylthiophene | 274.9 | 55.1 |
| Trimethylbenzothiophene | 2040.7 | 371.8 |
| Tetramethylbenzothiophene | <0.1 | <0.1 |
| DIBENZOTHIOPHENE | 49.7 | 8.7 |
| Methyldibenzothiophene | 39.3 | 6.4 |
| Ethyldibenzothiophene | 3.0 | 0.5 |
| 4,6 Dimethyldibenzothiophene | <0.1 | <0.1 |

TABLE 9-continued

| Jet Fuel Feedstock - sulphur analysis | | |
|---|---|---|
| | Concentration (ppm wt) | |
| Sulfur Compounds | as compound | as sulfur |
| Other Dimethyldibenzothiophene | <0.1 | <0.1 |
| Unidentified Sulfur Compounds | 527.2 | 126.0 |

Total Sulfur 1518.0 PPM WT

TABLE 10

| Jet Fuel - desulphurized - sulphur analysis | | |
|---|---|---|
| | Concentration (ppm wt) | |
| Sulfur Compounds | as compound | as sulfur |
| Hydrogen Sulfide | <0.1 | <0.1 |
| Carbonyl Sulfide | 0.4 | 0.2 |
| Methyl Mercaptan (Methanethiol) | <0.1 | <0.1 |
| Ethyl Mercaptan (Ethanethiol) | <0.1 | <0.1 |
| Isopropyl Mercaptan (2-Propanethiol) | <0.1 | <0.1 |
| n-Propyl Mercaptan (1-Propanethiol) | <0.1 | <0.1 |
| tert-Butyl Mercaptan (2-Methyt-2-Propanethiol) | <0.1 | <0.1 |
| sec-Butyl Mercaptan (1-Methyl-1-Propanethiol) | 0.3 | 0.1 |
| Isobutyl Mercaptan (2-Methyl-1-Propanethiol) | <0.1 | <0.1 |
| n-Butyl Mercaptan (1-Butanethiol) | <0.1 | <0.1 |
| Thiophenol(VinylMercaptan) | <0.1 | <0.1 |
| Methyl Sulfide | <0.1 | <0.1 |
| Carbon Disulfide | <0.1 | <0.1 |
| Ethylmethyl Sulfide | <0.1 | <0.1 |
| Ethyl Sulfide | <0.1 | <0.1 |
| Sulfides | <0.1 | <0.1 |
| Methyl Disulfide | <0.1 | <0.1 |
| Ethyl Disulfide | <0.1 | <0.1 |
| sec-Butyl Sulfide | <0.1 | <0.1 |
| n-Butyl Sulfide | <0.1 | <0.1 |
| n-Butyl DiSulfide | <0.1 | <0.1 |
| Phenyl Sulfide | <0.1 | <0.1 |
| Thiophene | <0.1 | <0.1 |
| 2-Methyl-Thiophene | <0.1 | <0.1 |
| 3-Methyl-Thiophene | <0.1 | <0.1 |
| TetrahydroThiophene | <0.1 | <0.1 |
| 2-Ethyl-Thiophene | <0.1 | <0.1 |
| Total DimethylThiophene | <0.1 | <0.1 |
| 3-Ethyl-Thiophene | <0.1 | <0.1 |
| Total TrimethylThiophene | 0.3 | <0.1 |
| Bromothiophene | <0.1 | <0.1 |
| Total TetrarmethylThiophene | 0.3 | <0.1 |
| Benzo[b]Thiophene (Thianaphthene) | <0.1 | <0.1 |
| Methylbenzothiophen | <0.1 | <0.1 |
| Dimethylbenzothiophene | <0.1 | <0.1 |
| Phenylthiophene | <0.1 | <0.1 |
| Trimethylbenzothiophene | 43.8 | 8.0 |
| Tetramethylbenzothiophene | <0.1 | <0.1 |
| DIBENZOTHIOPHENE | <0.1 | <0.1 |
| Methyldibenzothiophene | <0.1 | <0.1 |
| Ethyldibenzothiophene | <0.1 | <0.1 |
| 4,6 Dimethyldibenzothiophene | <0.1 | <0.1 |
| Other Dimethyldibenzothiophene | 1.0 | 0.1 |
| Unidentified Sulfur Compounds | 2.2 | 0.5 |

Total Sulfur 9.0 PPM WT

Discussion of Test Results

Natural Gas Condensate containing a total S level of 432 ppm (Table 2) was successfully desulphurized to a total S level of 4.8 ppm (see Table 4). The reaction kinetics are subject to optimization and differ according to which oxidation reactor is used for said oxidation reaction. It is empirically proven that Multistage Agitated Column's residence time is similar to the emulation using Static Mixers, which are both substantially different to the aforementioned options of Film Shear or Cavitation Reactors. The reaction requires less residence time in these PI (process intensification) type reactors, principally because of superior mass transfer.

Transmix Diesel Hydrocarbon containing a total S level of 407 ppm (see Table 5) was successfully desulphurized to a total S level of 9.2 ppm (see Table 6). Reaction kinetics resemble aforementioned residence time and mass transfer as per Natural Gas Condensate.

Refinery Diesel Hydrocarbon containing a total S level of 3996 ppm (table 7) was successfully desulphurized to a total S level of 10 ppm (Table 8). Reaction kinetics resemble aforementioned residence time and mass transfer as per Natural Gas Condensate.

Jet Fuel_containing a total S level of 1518 ppm (Table 9) was successfully desulphurized to a total S level of 9 ppm (Table 10). Reaction kinetics resemble aforementioned residence time and mass transfer as per Natural Gas Condensate.

The invention claimed is:

1. A process for reducing the sulphur content of a hydrocarbon material containing sulphur compounds, the process comprising:

a) contacting the hydrocarbon material with one or more primary oxidants to oxidize the sulphur compounds to sulphoxide and/or sulphone compounds to provide a primary oxidised hydrocarbon material, wherein the primary oxidant is at least one member selected from the group consisting of N-chloroimide, hypobromous acid, hypochlorous acid, electrolysed oxidizing water, and catalyzed and co-catalyzed hydrogen peroxide;

b) contacting the primary oxidised hydrocarbon material with a secondary oxidant to oxidizes sulphur compounds not oxidised by the primary oxidant to sulphoxide and/or sulphone compounds to provide a secondary oxidised hydrocarbon material, wherein the secondary oxidant is at least one member selected from the group consisting of hydroxyl radicals, liquid ferrate (iron VI), chlorine dioxide, and hypofluorous acid/polar solvent;

c) contacting the primary and/or secondary oxidised hydrocarbon material with an aqueous extractant to allow at least a portion of the sulphoxide and/or sulphone compounds to be extracted into the aqueous extractant to give a sulphoxide and/or sulphone stream and a low sulphur hydrocarbon stream; and d) contacting the sulphoxide and/or sulphone stream with a tertiary oxidant to give a sulphite stream and a low sulphur aromatic hydrocarbon steam, wherein the tertiary oxidant oxidises the sulphone and/or sulphoxide compounds to sulphite compounds.

2. The process according to claim 1 wherein the hydrocarbon material containing sulphur compounds has a sulphur mass of greater than 1000 ppm.

3. The process according to claim 1, wherein the secondary oxidant is contacted with the primary oxidised hydrocarbon material in at least a stochiometric amount.

4. The process according to claim 1, wherein the secondary oxidant is contacted with the primary oxidised hydrocarbon material at a temperature of less than about 35° C., and at a pressure of less than 700 kPa, and for a period of time in the range of about 30 seconds to 10 minutes.

5. A process for reducing the sulphur content of a hydrocarbon material containing sulphur compounds, the process comprising steps a), c), and d) or steps b), c), and d), as follows:

a) contacting the hydrocarbon material with one or more primary oxidants to give a primary oxidised hydrocarbon material wherein the primary oxidant is at least one member selected from the group consisting of N-chloroimide, hypobromous acid, hypochlorous acid, electrolyzed oxidizing water and catalysed and co-catalysed hydrogen peroxide, such that the primary oxidant oxidizes the sulphur compounds to sulphoxide and/or sulphone compounds; or b) contacting the hydrocarbon material or a primary oxidised hydrocarbon material containing sulphur compounds with a secondary oxidant to give a secondary oxidised hydrocarbon material wherein the secondary oxidant is at least one member selected from the group consisting of hydroxyl radicals, liquid ferrate (iron VI), chlorine dioxide and hypofluorous acid/polar solvent, such that the secondary oxidant oxidizes sulphur compounds to sulphoxide and/or sulphone compounds; and c) contacting the primary and/or secondary oxidised hydrocarbon material with an aqueous extractant to allow at least a portion of the sulphoxide and/or sulphone compounds to be extracted into the aqueous extractant to give a sulphoxide and/or sulphone stream and a low sulphur hydrocarbon stream; and d) contacting the sulphoxide and/or sulphone stream with a tertiary oxidant to give a sulphite stream and a low sulphur aromatic stream, wherein the tertiary oxidant oxidises the sulphone and/or sulphoxide compounds to sulphite compounds.

6. A process for reducing the sulphur content of a hydrocarbon material containing sulphur compounds according to claim 1 or 5, the process comprising:

a) contacting the hydrocarbon material with one or more primary oxidants to provide a primary oxidised hydrocarbon material such that the primary oxidant oxidizes the sulphur compounds to sulphoxide and/or sulphone compounds, wherein the primary oxidant is at least one member selected from the group consisting of N-chloroimide, hypobromous acid, hypochlorous acid, electrolyzed oxidizing water and catalysed and co-catalysed hydrogen peroxide, and wherein the catalysed and co-catalysed hydrogen peroxide is hydrogen peroxide catalysed by phosphotungstic acid and co-catalysed by a Phase Transfer Catalyst (PTC);

and b) contacting the primary oxidised hydrocarbon material with a secondary oxidant to give a secondary oxidised hydrocarbon material wherein the secondary oxidant is at least one member selected from the group consisting of hydroxyl radicals, liquid ferrate (iron VI), chlorine dioxide and hypofluorous acid/polar liquid solvent, such that the secondary oxidant oxidizes sulphur compounds to sulphoxide and/or sulphone compounds;

and c) contacting the primary and/or secondary oxidised hydrocarbon material with an aqueous extractant to allow at least a portion of the sulphoxide and/or sulphone compounds to be extracted into the aqueous extractant to give a sulphoxide and/or sulphone stream and a low sulphur hydrocarbon stream;

and d) contacting the sulphoxide and/or sulphone stream with a tertiary oxidant to give an aqueous sulphite stream and a low sulphur aromatic hydrocarbon stream, wherein the tertiary oxidant oxidises sulphone and/or sulphoxide compounds to sulphite compounds.

7. The process according to claim 1 or 5 wherein the primary oxidant is N-chloroimide.

8. The process according to claim 7 wherein the N-chloroimide is prepared by reaction of sodium hypochlorite, water and an imide.

9. The process according to claim 8 wherein the imide is cyanuric acid.

10. The process according to claim 7 wherein N-chloroimide is prepared in situ.

11. The process according to claim 1 or 5 wherein the primary oxidant is is hypobromous or hypochlorous acid.

12. The process according to claim 11 wherein the hypobromous acid is prepared in situ by electrolysis of hydrogen bromide in water.

13. The process according to claim 1 or 5 wherein the primary oxidant is electrolysed oxidising water.

14. The process according to claim 1 or 5 wherein the catalysed and co-catalysed hydrogen peroxide is hydrogen peroxide catalysed by phosphotungstic acid and co-catalysed with a Phase Transfer Catalyst (PTC).

15. The process according to claim 1 or 5 wherein the catalysed and co-catalysed hydrogen peroxide is hydrogen peroxide catalysed by phosphotungstic acid comprising sodium tungstate dihydrate and phosphoric acid and co-catalysed by a phase transfer catalyst (PTC) comprising a quaternary ammonium salt selected from the group consisting of quaternary ammonium hydrogen sulphates, methyltrialkyl($C_8$-$C_{10}$)ammonium chloride and N-Methyl-N,N-dioctyloctane-1-ammonium chlorides.

16. The process according to claim 15 wherein the hydrogen peroxide is catalysed by phosphotungstic acid and co-catalysed by a tri-C8-10-alkylmethyl, hydrogen sulfate.

17. The process according to claim 1 or 5 wherein the hydrocarbon material is contacted with the primary oxidant in at least a stoichiometric amount for the conversion of sulphur compounds to sulphoxide and/or sulphone compounds.

18. The process according to claim 5 wherein the hydrocarbon material is contacted with the primary oxidant or the secondary oxidant.

19. The process according to claim 5 wherein the hydrocarbon material is contacted with the primary oxidant and the primary oxidised hydrocarbon is contacted with the secondary oxidant.

20. The process according to claim 5 wherein the secondary oxidant has an oxidation reduction potential (ORP) of ≥1550 mV.

21. The process according to claim 5 wherein the secondary oxidant is contacted with the primary oxidised hydrocarbon material or the hydrocarbon material in at least a stochiometric amount.

22. The process according to claim 5 wherein the secondary oxidant is contacted with the primary oxidised hydrocarbon material or the hydrocarbon material at a temperature of less than about 35° C., and at a pressure of less than 700 kPa, and for a period of time in the range of about 30 seconds to 10 minutes.

23. The process according to claim 1 or 5 wherein the secondary oxidant is chlorine dioxide, in the form of a stabilised water solution having a chlorine dioxide content in the range of about 3000 ppm (0.3%) to 8000 ppm (0.8%).

24. The process according to claim 1 or 5 wherein the secondary oxidant is hypofluorous acid in acetonitrile, prepared by bubbling a gaseous mixture comprising fluorine and nitrogen into liquid acetonitrile to form $HOF.CH_3CN$, wherein the concentration of fluorine mixed with nitrogen does not exceed 20% by weight fluorine blended with the nitrogen.

25. The process according to claim 1 or 5 wherein the secondary oxidant is hydroxyl radicals.

26. The process according to claim 1 or 5 wherein the secondary oxidant is Liquid Ferrate VI.

27. The process according to claim 1 or 5 wherein in step c) the primary and/or secondary oxidised hydrocarbon material is contacted with an ionic liquid (IL) or a polar extraction solvent for a time and under conditions to allow at least a portion of the sulphoxide and/or sulphone compounds to be extracted or absorbed into the extraction solvent or liquid.

28. The process according to claim 27 wherein the extractant is selected from the group consisting of DMF, DMSO, Methanol, Furfural, Water, Acetonitrile, and combinations thereof.

29. The process according to claim 27 wherein a liquid/liquid extraction or ion exchange adsorption process is used to extract the sulphone/sulphoxide compounds.

30. The process according to claim 1 or 5 wherein the first and/or second oxidised hydrocarbon material obtained from step a) and/or step c) are washed with water.

31. The process according to claim 1 or 5 wherein the tertiary oxidant is a caustic solution, selected from the group consisting of:

i) sodium hydroxide, ii) potassium hydroxide and iii) hydroxyl radicals.

32. The process according to claim 1 or 5 wherein the tertiary oxidant is sodium hydroxide and an aqueous sodium sulphite solution is formed.

33. The process according to claim 32 wherein the sodium hydroxide solution is in a concentration of about 30-60%.

34. The process according to claim 1 or 5 wherein the tertiary oxidant is hydroxyl radicals such that following addition of water, sulphuric acid forms.

35. The process according to claim 34 wherein the stoichiometric ratio of hydroxyl radicals to sulphone/sulphoxide is in the range of about 1:1 to 4:1.

36. The process according to claim 1 or 5 wherein the low sulphur hydrocarbon stream and the low sulphur aromatic compound are combined and recycled as low sulphur hydrocarbon fuel.

37. The process according to claim 1 or 5 wherein the process further comprises:

e) contacting the low sulphur hydrocarbon stream obtained in step c) with an adsorbent to remove residual sulphur compounds from the low sulphur hydrocarbon stream (LSD) to provide an ultra low sulphur hydrocarbon stream (ULSD).

38. The process according to claim 37 wherein the adsorbent is selected from physical or physiochemical adsorbents, Y-zeolite, activated carbon and Metal Oxide Framework (MOF).

39. The process according to claim 37 wherein following step e) the loaded absorbent is regenerated/purged using heater N2, stripping to desorb sulfur compounds from the adsorbent.

40. The process according to claim 1 or 5 further including the step of separating the sulphone/sulphoxide stream and the low sulphur hydrocarbon stream produced in step c).

41. The process according to claim 1 or 5 wherein the low sulphur hydrocarbon stream obtained in step c) is polished using adsorbents including MOF (Metal Organic Framework), ($C_{18}H_6Cu_3O_{12}$)-Copper Benzene-1,3,5-Tricarboxylate, Metal Oxide Purification Adsorbent group of adsorbents, $CuCl_2$MIL-47 MOF, Y-Zeolite, Molecular Imprinted Chitosan or Activated Carbon.

42. A method for regenerating an aromatic and/or aliphatic sulfone and/or sulphoxide compound to a sulphone and/or sulphoxide free aromatic and/or aliphatic compound comprising contacting the aromatic and/or aliphatic sulfone and/or sulphoxide compound with hydroxyl radicals to form the sulphone and/or sulphoxide free aromatic and/or aliphatic compound and a sulphite, wherein the aromatic and/or aliphatic sulphone and/or sulphoxide compound is the sulphoxide/sulphone compound formed in the process according to steps a) and b) of claim 1 or steps a) or b) of claim 5.

43. A method for regenerating an aromatic and/or aliphatic sulfone and/or sulphoxide compound to a sulphone and/or sulphoxide free aromatic and/or aliphatic compound comprising contacting the aromatic and/or aliphatic sulfone and/or sulphoxide compound with hydroxyl radicals to form the sulphone and/or sulphoxide free aromatic and/or aliphatic compound and a sulphite.

44. The method according to claim 43 wherein the sulphite is hydrated to sulphuric acid.

45. A method of oxidizing a sulphur compound in a hydrocarbon material, comprising providing a quaternary ammonium salt for use as a co-catalyst with catalysed hydrogen peroxide in the oxidation of the sulphur compounds in the hydrocarbon material.

46. The method of claim 45 wherein the catalysed hydrogen peroxide is hydrogen peroxide catalysed by a catalyst selected from transition metals, noble metals and breakdown rate control catalysts.

47. The method of claim 46 wherein the breakdown rate control catalysts is phosphotungstic acid and the quaternary ammonium salt is a PTC selected from the group consisting of tri-C8-10-alkylmethyl, hydrogen sulfates; methyltrialkyl ($C_8$-$C_{10}$)ammonium chloride; and N-Methyl-N,N-dioctyloctane-1-ammonium salts such as the chloride.

48. A process for reducing the sulphur content of a hydrocarbon material containing sulphur compounds, the process comprising:

a) contacting the hydrocarbon material with one or more primary oxidants to oxidize the sulphur compounds to sulphoxide and/or sulphone compounds to provide a primary oxidised hydrocarbon material, wherein the primary oxidant comprises a catalyzed and co-catalyzed hydrogen peroxide or has an ORP of up to about 1550 mV, b) contacting the primary oxidised hydrocarbon material with a secondary oxidant to oxidize sulphur compounds not oxidised by the primary oxidant to sulphoxide and/or sulphone compounds to provide a secondary oxidised hydrocarbon material, wherein the secondary oxidant comprises chlorine dioxide or has an ORP of greater than about 1550 mV, c) contacting the primary and/or secondary oxidised hydrocarbon material with an aqueous extractant to allow at least a portion of the sulphoxide and/or sulphone compounds to be extracted into the aqueous extractant to give a sulphoxide and/or sulphone stream and a low sulphur hydrocarbon stream; and d) contacting the sulphoxide and/or sulphone stream with a tertiary oxidant to give a sulphite stream and a low sulphur aromatic hydrocarbon steam, wherein the tertiary oxidant oxidises the sulphone and/or sulphoxide compounds to sulphite compounds.

49. The process according to claim 48, wherein the primary oxidant is a catalysed and co-catalysed hydrogen peroxide, said hydrogen peroxide being catalysed by phosphotungstic acid and co-catalysed with a Phase Transfer Catalyst (PTC).

50. The process according to claim 48, wherein the primary oxidant is the catalysed and co-catalysed hydrogen peroxide, said hydrogen peroxide being catalysed by phosphotungstic acid comprising sodium tungstate dihydrate and phosphoric acid and co-catalysed by a phase transfer catalyst (PTC) comprising a quaternary ammonium salt selected from the group consisting of quaternary ammonium hydrogen sulphates, methyltrialkyl($C_8$-$C_{10}$)ammonium chloride and N-Methyl-N,N-dioctyloctane-1-ammonium chlorides.

51. The process according to claim 48, wherein the primary oxidant is the catalysed and co-catalysed hydrogen peroxide, said hydrogen peroxide being catalysed by phosphotungstic acid and co-catalysed by a tri-C8-10-alkylmethyl, hydrogen sulfate.

52. The process according to claim 48, wherein the hydrocarbon material is contacted with the primary oxidant in at least a stoichiometric amount for the conversion of sulphur compounds to sulphoxide and/or sulphone compounds.

53. The process according to claim 48, wherein the secondary oxidant is the chlorine dioxide, in the form of a stabilised water solution having a chlorine dioxide content in the range of about 3000 ppm (0.3%) to 8000 ppm (0.8%).

54. The process according to claim 48, wherein the secondary oxidant is hypofluorous acid in acetonitrile, prepared by bubbling a gaseous mixture comprising fluorine and nitrogen into liquid acetonitrile to form $HOF.CH_3CN$, wherein the concentration of fluorine mixed with nitrogen does not exceed 20% by weight fluorine blended with the nitrogen.

55. The process according to claim 48, wherein the secondary oxidant is hydroxyl radicals.

56. The process according to claim 48, wherein the secondary oxidant is Liquid Ferrate VI.

57. The process according to claim 48, wherein in step c) the primary and/or secondary oxidised hydrocarbon material is contacted with an ionic liquid (IL) or a polar extraction solvent for a time and under conditions to allow at least a portion of the sulphoxide and/or sulphone compounds to be extracted or absorbed into the extraction solvent or liquid.

58. The process according to claim 57, wherein the extractant is selected from the group consisting of DMF, DMSO, Methanol, Furfural, Water, Acetonitrile, and combinations thereof.

59. The process according to claim 48, wherein the tertiary oxidant is a caustic solution, selected from the group consisting of:

i) sodium hydroxide, ii) potassium hydroxide, and iii) hydroxyl radicals.

60. The process according to claim 48, wherein the low sulphur hydrocarbon stream obtained in step c) is polished using adsorbents including MOF (Metal Organic Framework), ($C_{18}H_6Cu_3O_{12}$)-Copper Benzene-1,3,5-Tricarboxylate, Metal Oxide Purification Adsorbent group of adsorbents, $CuCl_2$MIL-47 MOF, Y-Zeolite, Molecular Imprinted Chitosan or Activated Carbon.

* * * * *